US008105682B2

(12) United States Patent
Sun et al.

(10) Patent No.: US 8,105,682 B2
(45) Date of Patent: Jan. 31, 2012

(54) THERMOPLASTIC POLYMER MICROFIBERS, NANOFIBERS AND COMPOSITES

(75) Inventors: Gang Sun, Davis, CA (US); Dong Wang, Davis, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 12/310,612

(22) PCT Filed: Aug. 31, 2007

(86) PCT No.: PCT/US2007/077394
§ 371 (c)(1),
(2), (4) Date: Jun. 4, 2010

(87) PCT Pub. No.: WO2008/028134

PCT Pub. Date: Mar. 6, 2008

(65) Prior Publication Data

US 2010/0233458 A1 Sep. 16, 2010

Related U.S. Application Data

(60) Provisional application No. 60/824,414, filed on Sep. 1, 2006.

(51) Int. Cl.
*D04H 1/00* (2006.01)

(52) U.S. Cl. ..... 428/292.1

(58) Field of Classification Search ..... 428/292.1; 528/272

See application file for complete search history.

(56) References Cited

U.S. PATENT DOCUMENTS 4,855,234 A * 8/1989 Hendrickson et al. ..... 435/181
5,366,804 A 11/1994 Dugan
5,446,079 A * 8/1995 Buchanan et al. ..... 524/41
5,656,682 A 8/1997 Rimsa et al.
5,728,824 A 3/1998 Narayan et al.
6,342,304 B1 * 1/2002 Buchanan et al. ..... 428/480
6,503,616 B1 * 1/2003 Jalan ..... 428/323
6,562,938 B2 * 5/2003 Haile et al. ..... 528/271
6,692,823 B2 2/2004 Kody et al.
6,872,311 B2 3/2005 Koslow
7,014,803 B2 3/2006 Perez et al.
7,452,920 B2 * 11/2008 Lin et al. ..... 521/65

(Continued)

OTHER PUBLICATIONS

International Search Report mailed on Jan. 24, 2008, for International Patent Application No. PCT/US07/77394 filed on Aug. 31, 2007, 3 pages.

*Primary Examiner* — N. Edwards

(74) *Attorney, Agent, or Firm* — Kilpatrick Townsend & Stockton LLP

(57) ABSTRACT

The present invention provides methods of making micron, submicron or nanometer dimension thermoplastic polymer microfibrillar composites and fibers, and methods of using the thermoplastic polymer microfibers and nanofibers in woven fabrics, biocidal textiles, biosensors, membranes, filters, protein support and organ repairs. The methods typically include admixing a thermoplastic polymer and a matrix material to form a mixture, where the thermoplastic and the matrix are thermodynamically immiscible, followed by extruding the mixture under conditions sufficient to form a microfibrillar composite containing a plurality of the thermoplastic polymer microfibers and/or nanofibers embedded in the matrix material. The microfibers and/or nanofibers are isolated by removing the surrounding matrix. In one embodiment, the microfibrillar composite formed is further extended under conditions sufficient to form a drawn microfibrillar and/or nanofibrillar composite with controlled diameters.

15 Claims, 17 Drawing Sheets

U.S. PATENT DOCUMENTS 7,790,640 B2 * 9/2010 Chakravarty et al. ..... 442/335
7,888,405 B2 * 2/2011 Gohil et al. ..... 523/124
2002/0132960 A1 * 9/2002 Haile et al. ..... 528/272
2007/0024903 A1 * 2/2007 Kitahara et al. ..... 358/1.15
2010/0233458 A1 * 9/2010 Sun et al. ..... 428/292.1

* cited by examiner (a) CAB/LDPE=80/20 x 500

(b ) CAB/HCDP=80/20 x 500

(a) CAB/PET=20/80, L/D=15 after drawing (b) CAB/IPET-PEG=20/80, L/D=30 after drawing

THERMOPLASTIC POLYMER MICROFIBERS, NANOFIBERS AND COMPOSITES

CROSS-REFERENCES TO RELATED APPLICATIONS

This application claims priority to U.S. Provisional Patent Application No. 60/824,414, filed Sep. 1, 2006, which is hereby incorporated by reference in its entirety for all purposes.

BACKGROUND OF THE INVENTION

Composite materials commonly consist of a continuous, bulk or matrix phase, and a discontinuous, dispersed, fiber, or reinforcement phase, and can be produced by mixing two immiscible polymers. Some composites have a relatively brittle matrix and a relatively ductile or pliable reinforcement. The relatively pliable reinforcement, which can be in the form of fibers, can serve to impart toughness to the composite. Specifically, the reinforcement may inhibit crack propagation as cracks through the brittle matrix are deflected and directed along the length of the fibers. Other composites have a relatively soft matrix and a relatively rigid or strong reinforcement phase, which can include fibers. Such fibers can impart strength to the matrix, by transferring applied loads from the weak matrix to the stronger fibers.

Microfibers that impart additional strength may be formed of polymers, metals, or other materials. Many materials, such as metals, have the disadvantage of relatively high weight and density. Other materials, such as glass, may be inexpensive and lighter, but may wick moisture into the composite, which may then make the composite unsuitable for some applications. In particular, long-term submersion in water may lead to significant water uptake and decomposition, including delamination in some applications. The wicking may be caused by less than optimal adhesion between the fibers and the matrix phase, allowing moisture to be wicked in through the elongated voids formed between the fibers and the matrix. Use of inexpensive polymers, such as polyolefins or polyesters would be advantageous with respect to cost and weight, but known olefin fibers that are strong enough to impart the required strength to the composite may not be capable of receiving stress from the matrix, because of the low surface energy nature of known olefin fiber surfaces. Inexpensive polymer fibers such as polyolefin or polyester fibers may also allow wicking of moisture even though they are hydrophobic in nature.

The production of polymer microfibers from polymer films is well known. Typically, molten polymer is extruded through a die or small orifice in a continuous manner to form a continuous thread. The fiber can be further drawn to create an oriented filament with significant tensile strength. Fibers created by a traditional melt spinning process are generally larger than 15 microns. Smaller fiber sizes are impractical because of the high melt viscosity of the molten polymer. Fibers with a diameter less than 15 microns can be created by a melt blowing process. However, the resins used in this process have a low molecular weight and viscosity rendering the resulting fibers very weak. In addition, a post spinning process such as length orientation cannot be used.

One typical method to obtain in situ composites is to blend thermotropic liquid crystal polymers (TLCPs) with thermoplastic polymer (TP) matrixes [see, e.g., G. Kiss, *Polymer Engineering and Science,* 27:410 (1987); Y. Qin et al., *Polymer,* 34:1196-1201 (1993); Y. Qin et al., Polymer, 34:1202-1206 (1993); Markku T. Heino et al., *Journal of applied polymer science,* 51:259-270 (1994); F. J. Vallejo et al., *Polymer,* 41:6311-6321 (2000)]. Considering the high cost of TLCPs for industry applications, replacing the TLCPs with general engineering TP to prepare in situ microfibrillar composites is highly desirable.

Another method to prepare in situ microfibril reinforced composites is through a melt extrusion-cold drawing-thermal treatment process [see, e.g., M. Evstatiev and S. Fakirov, *Polymer,* 33:877-880 (1992); K. Friedrich et al., *Composites Science and Technology,* 65:107-116 (2005); S. Fakirov and M. Evstatiev, *Polymer,* 34:4669-4679 (1993); S. Fakirov et al., *Macromolecules,* 26:5219-5226 (1993); M. Evstatiev and N. Nicolov, *Polymer,* 37:4455-4463 (1996); S. Fakirov et al., *Journal of Macromolecular Science, Part B-Physics*, B43: 775-789 (2004); M. Evstatiev et al., *Advances in Polymer Technology,* 19:249-259 (2000); A. A. Apostolov et al., *Progr Colloid Polym Sci,* 130:159-166 (2005); M. Krumova et al., *Progr Colloid Polym Sci,* 130:167-173 (2005); K. Friedrich et al., *Composites Science and Technology,* 65:107-116 (2005); Z. M. Li et al., *Materials Research Bulletin,* 37:2185-2197 (2002)].

Pennings et al., in "Mechanical properties and hydrolyzability of Poly(L-lactide) Fibers Produced by a Dry-Spinning Method" *J. Appl. Polym. Sci.,* 29, 2829-2842 (1984) described fibers with a fibrillar structure by solution spinning using chloroform in the presence of various additives (camphor, polyurethanes) followed by hot drawing. These fibers showed good mechanical properties and improved degradability in vitro with the fibrillar structure speeding up the hydrolysis of the fiber. The inherent disadvantage of this process is the use of chlorinated solvents in the spinning process. Composite fiber with in situ microfibril provide a promising method to prepare microfibers.

Microfibers with a diameter of 1 micrometer and a round cross-section have also been produced by electrospining. The electrospining technique suffers from the disadvantage of using a chlorinated solvent and has low production speed. In view of the foregoing, there is a need to develop other efficient methods for production of microfibrillar composites, microfibers and nanofibers of thermoplastic polymers for applications in biosensors, membranes, filters, protein support, and organ repairs as well as for the manufacture of woven fabrics including biocidal textiles. The present invention satisfies these and other needs.

BRIEF SUMMARY OF THE INVENTION

The present invention provides microfibrillar and nanofibrillar composites, microfibers, nanofibers and methods of making and using microfibers and nanofibers.

In one aspect, the present invention provides a thermoplastic polymer nanofibrillar composite. The composite includes a matrix and a thermoplastic polymer nanofiber embedded in the matrix, wherein the thermoplastic polymer nanofiber has a diameter less than 1 μm and a predetermined cross-section.

In another aspect, the present invention provides a thermoplastic polymer nanofiber. In one embodiment, the thermoplastic polymer nanofiber includes a polyolefin nanofiber, such as a poly(α-olefin) nanofiber and a polyester nanofiber.

In yet another aspect, the present invention provides a method for preparing a nanofibrillar composite. The method includes admixing a thermoplastic polymer and a matrix material to form a mixture, wherein the thermoplastic polymer and the matrix material are thermodynamically immiscible; and extruding the mixture under conditions sufficient to form a nanofibrillar composite, wherein the composite comprises a plurality of the thermoplastic polymer nanofibers embedded in the matrix material. In one embodiment, the nanofibrillar composite is extended under conditions sufficient to form a drawn nanofibrillar composite.

In still yet another aspect, the present invention provides a method for preparing a thermoplastic polymer nanofiber. The method includes admixing a thermoplastic polymer and a matrix material to form a mixture, wherein the thermoplastic polymer and the matrix material are thermodynamically immiscible; and extruding the mixture under conditions sufficient to form a nanofibrillar composite, wherein the nanofibrillar composite comprises a thermoplastic polymer nanofiber having a diameter less than 1 μm embedded in the matrix material; and removing the matrix material to generate a thermoplastic polymer nanofiber.

In a further aspect, the present invention provides a thermoplastic polymer microfibrillar composite. The composite includes a matrix; and a thermoplastic polymer microfiber embedded in the matrix, wherein the thermoplastic polymer microfiber has a diameter less than 10 μm and a predetermined cross-section.

In another aspect, the present invention provides a thermoplastic polymer microfiber having a diameter less than 10 μm. In one embodiment, the present invention provides a tactic polyolefin microfiber, for example, an isotactic or a syndiotatic polypropylene microfiber.

In yet another aspect, the present invention provides a method for preparing a microfibrillar composite. The method includes admixing a thermoplastic polymer and a matrix material to form a mixture, wherein the thermoplastic polymer and the matrix material are thermodynamically immiscible; and extruding the mixture under conditions sufficient to form a microfibrillar composite, wherein the composite comprises a plurality of the thermoplastic polymer microfibers embedded in the matrix material. In one embodiment, the microfibrillar composite is extended under conditions sufficient to form a drawn microfibrillar composite.

In still another aspect, the present invention provides a method for preparing a thermoplastic polymer microfiber. The method includes removing the matrix material surrounding the microfibrillar composite material to form a thermoplastic polymer microfiber. In one embodiment, the matrix material is dissolved by a solvent, such as an organic solvent.

In a further aspect, the present invention provides a use of microfibers and nanofibers in woven fabrics, membranes and filters.

Further features and advantages of the present invention, as well as the structure and operation of various embodiments of the present invention, are described in detail below with respect to the accompanying drawings.

BRIEF DESCRIPTION OF THE DRAWINGS

(FIG. 9A) and 260° C. (FIG. 9B).

DETAILED DESCRIPTION OF THE INVENTION

Figure 1A:
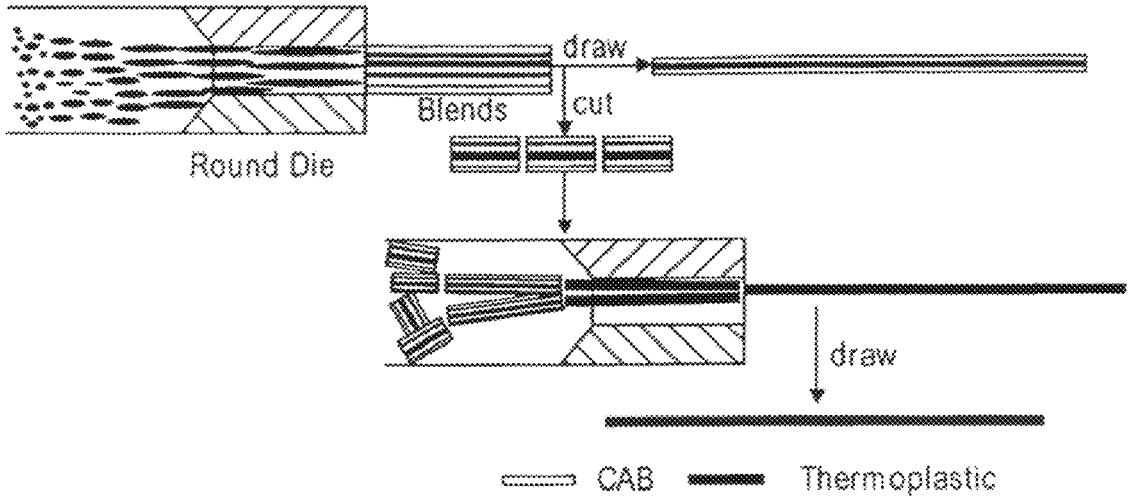
FIG. 1A illustrates a schematic diagram of the formation process of in situ microfibrillar and lamellar blends.

The present invention relates to thermoplastic polymer microfibrillar and nanofibrillar composites, thermoplastic polymer microfibers, thermoplastic polymer nanofibers and methods of formation and use of thermoplastic polymer micro and/or nano fibers and/or composites. Suitable applications include, but are not limited to, woven fabrics, biocidal textiles, biosensors, membranes, filters, protein support and organ repairs. In particular, the present invention provides a series of novel thermoplastic/matrix composites, which are prepared through admixing and extrusion processes, where the microfibers and nanofibers can be isolated by removing the matrix material through a simple dissolution process. For example, a thermoplastic/cellulose acetate butyrate (CAB) in situ microfibrillar composite is prepared through ram extrusion with general round die and a hot drawing process. Microfibers and/or nanofibers are prepared by removing the matrix material from the composite, for example, fibers of micro and nano dimensions are obtained by dissolving the CAB in a solvent. Examples of the thermoplastics, which are used as a dispersed phase and are capable of forming microfibril in the CAB matrix can include, but are not limited to, most of general thermoplastics, such as low density polyethylene (LDPE), high density polyethylene (HDPE), isotactic polypropylene (iPP), polyethylene terephthalate (PET), polytrimethylene terephthalate (PTT), polybutylene terephthalate (PBT), poly(butylene adipate terephthalate) (PBAT), poly(Ethylene terephthalate-co-isophthalate)-poly(ethylene glycol) (IPET-PEG), and a highly modified cationic ion-dyeable polyester (HCDP). The process has the advantages of ease of operation, being environmentally friendly, use of single extruder and formation of microfibers and/or nanofibers having controlled dimensions. The matrix material is reusable and biodegradable. The microfibers and nanofibers are useful in biosensors, membranes, filters, protein support, and organ repair as well as for the manufacture of woven fabrics including biocidal textiles.

The general processes for producing microfiber composites include melt blending and extrusion of the two thermoplastic polymers with different melting temperatures, followed by solid state cold drawing or hot stretching, during this process, high melting component as dispersed phase was deformed and converted into microfibril. Then the in situ microfibrillar composites are fabricated by injection molding, compression molding and film extrusion at a processing temperature higher than $T_m$ of low melting matrix but lower than that of the high melting microfibril component to prevent the microfibrillar component from relaxing and returning to more stable spherical morphology.

I. DEFINITIONS

As used herein, the term "thermoplastic" includes a material that is plastic or deformable, melts to a liquid when heated and freezes to a brittle, glassy state when cooled sufficiently. Thermoplastic are typically high molecular weight polymers. Examples of thermoplastic polymers that can be used include polyacetals, polyacrylics, polycarbonates, polystyrenes, polyolefins, polyesters, polyamides, polyaramides, polyamideimides, polyarylates, polyurethanes, epoxies, phenolics, silicones, polyarylsulfones, polyethersulfones, polyphenylene sulfides, polysulfones, polyimides, polyetherimides, polytetrafluoroethylenes, polyetherketones, polyether etherketones, polyether ketone ketones, polybenzoxazoles, polyoxadiazoles, polybenzothiazinophenothiazines, polybenzothiazoles, polypyrazinoquinoxalines, polypyromellitimides, polyquinoxalines, polybenzimidazoles, polyoxindoles, polyoxoisoindolines, polydioxoisoindolines, polytriazines, polypyridazines, polypiperazines, polypyridines, polypiperidines, polytriazoles, polypyrazoles, polycarboranes, polyoxabicyclononanes, polydibenzofurans, polyphthalides, polyacetals, polyanhydrides, polyvinyl ethers, polyvinyl thioethers, polyvinyl alcohols, polyvinyl ketones, polyvinyl halides, polyvinyl nitriles, polyvinyl esters, polysulfonates, polysulfides, polythioesters, polysulfones, polysulfonamides, polyureas, polyphosphazenes, polysilazanes, polypropylenes, polyethylenes, polyethylene terephthalates, polyvinylidene fluorides, polysiloxanes, or the like, or a combination comprising at least one of the foregoing thermoplastic polymers. In some embodiments, polyolefins include polyethylene, poly(α-olefin)s. As used herein, poly(α-olefin) means a polymer made by polymerizing an alpha-olefin. An α-olefin is an alkene where the carbon-carbon double bond starts at the α-carbon atom. Examplary poly(α-olefin)s include polypropylene, poly(1-butene) and polystyrene. Exemplary polyesters include condensation polymers of a $C_{2-10}$dicarboxylic acid and a $C_{2-10}$alkylenediol. Exemplary polyamides include condensation polymers of a $C_{2-10}$dicarboxylic acid and a $C_{2-10}$alkylenediamine.

As used herein, the term "matrix" includes a material that can support the microfibers or nanofibers formed. Preferable, the matrix is a material that is thermodynamically immiscible with the thermoplastic polymers and soluble in a solvent.

As used herein, the term "extrusion" includes a manufacturing process where a material, often in the form of a cast product, is pushed and/or drawn through a die to create long objects of a fixed cross-section.

"Alkyl" includes a straight or branched, saturated aliphatic radical containing one to eight carbon atoms, unless otherwise indicated e.g., alkyl includes methyl, ethyl, propyl, isopropyl, butyl, sec-butyl, iso-butyl, t-butyl, and the like.

"Alkoxy" includes —OR radical where R is alkyl as defined above e.g., ethoxy, ethoxy, and the like.

"Heteroalkyl" includes an alkyl radical as defined herein with one, two or three substituents independently selected from nitro, cyano, —$OR^w$, —$NR^xR^y$, and —$S(O)_nR^z$ (where n is an integer from 0 to 2), with the understanding that the point of attachment of the heteroalkyl radical is through a carbon atom of the heteroalkyl radical. $R^w$ is hydrogen, alkyl, cycloalkyl, cycloalkyl-alkyl, aryl, aralkyl, alkoxycarbonyl, aryloxycarbonyl, carboxamido, or mono- or di-alkylcarbamoyl. $R^x$ is hydrogen, alkyl, cycloalkyl, cycloalkyl-alkyl, aryl or aralkyl. $R^y$ is hydrogen, alkyl, cycloalkyl, cycloalkyl-alkyl, aryl, aralkyl, alkoxycarbonyl, aryloxycarbonyl, carboxamido, mono- or di-alkylcarbamoyl or alkylsulfonyl. $R^z$ is hydrogen (provided that n is 0), alkyl, cycloalkyl, cycloalkyl-alkyl, aryl, aralkyl, amino, mono-alkylamino, di-alkylamino, or hydroxyalkyl. Representative examples include, for example, 2-hydroxyethyl, 2,3-dihydroxypropyl, 2-methoxyethyl, benzyloxymethyl, 2-cyanoethyl, and 2-methylsulfonyl-ethyl. For each of the above, $R^w$, $R^x$, $R^y$, and $R^z$ can be further substituted by amino, fluorine, alkylamino, di-alkylamino, OH or alkoxy. Additionally, the prefix indicating the number of carbon atoms (e.g., $C_1$-$C_{10}$) refers to the total number of carbon atoms in the portion of the heteroalkyl group exclusive of the cyano, —$OR^w$, —$NR^xR^y$, or —$S(O)_nR^z$ portions. As used herein, heteroalkyl also means a straight or branched chain consisting of the stated number of carbon atoms and from one to three heteroatoms selected from the group consisting of O, N, Si, for example, Si, S, —N, —N—, —N═, —O, —O—, O═, —S—, —SO— and —$S(O)_2$—, and wherein the nitrogen and sulfur atoms may optionally be oxidized and the nitrogen heteroatom may optionally be quaternized. The heteroatom(s) O, N and S may be placed at any interior position of the heteroalkyl group.

The term "aryl" includes a monovalent monocyclic, bicyclic or polycyclic aromatic hydrocarbon radical of 5 to 10 ring atoms which is unsubstituted or substituted independently with one to four substituents, preferably one, two, or three substituents selected from alkyl, cycloalkyl, cycloalkyl-alkyl, halo, cyano, hydroxy, alkoxy, amino, acylamino, mono-alkylamino, di-alkylamino, haloalkyl, haloalkoxy, heteroalkyl, COR (where R is hydrogen, alkyl, cycloalkyl, cycloalkylalkyl, phenyl or phenylalkyl, aryl or arylalkyl), —(CR'R")$_n$—COOR (where n is an integer from 0 to 5, R' and R" are independently hydrogen or alkyl, and R is hydrogen, alkyl, cycloalkyl, cycloalkylalkyl, phenyl or phenylalkyl aryl or arylalkyl) or —(CR'R")$_n$—CONR$^a$R$^b$ (where n is an integer from 0 to 5, R' and R" are independently hydrogen or alkyl, and R$^a$ and R$^b$ are, independently of each other, hydrogen, alkyl, cycloalkyl, cycloalkylalkyl, phenyl or phenylalkyl, aryl or arylalkyl). More specifically the term aryl includes, but is not limited to, phenyl, biphenyl, 1-naphthyl, and 2-naphthyl, and the substituted forms thereof.

"Heteroaryl" means a group or part of a group denotes an aromatic monocyclic or bicyclic moiety of 5 to 10 ring atoms in which one or more, preferably one, two, or three, of the ring atom(s) is(are) selected from nitrogen, oxygen or sulfur, the remaining ring atoms being carbon. Representative heteroaryl rings include, but are not limited to, pyrrolyl, furanyl, thienyl, oxazolyl, isoxazolyl, thiazolyl, imidazolyl, triazolyl, tetrazolyl, pyridinyl, pyrimidinyl, pyrazinyl, pyridazinyl, indolyl, benzofuranyl, benzothiophenyl, thiophenyl, benzimidazolyl, quinolinyl, isoquinolinyl, quinazolinyl, quinoxalinyl, pyrazolyl, and the like.

The above terms (e.g., "alkyl," "aryl" and "heteroaryl"), in some embodiments, will include both substituted and unsubstituted forms of the indicated radical. Preferred substituents for each type of radical are provided below.

Substituents for the aryl and heteroaryl groups are varied and are generally selected from: -halogen, —OR', —OC(O)R', —NR'R", —SR', —R', —CN, —$NO_2$, —$CO_2$R', —CONR'R", —C(O)R', —OC(O)NR'R", —NR"C(O)R', —NR"C(O)$_2$R', —NR'—C(O)NR"R"', —NH—C($NH_2$)═NH, —NR'C($NH_2$)═NH, —NH—C($NH_2$)═NR', —S(O)R', —S(O)$_2$R', —S(O)$_2$NR'R", —NR'S(O)$_2$R", —$N_3$, perfluoro($C_1$-$C_4$)alkoxy, and perfluoro($C_1$-$C_4$)alkyl, in a number ranging from zero to the total number of open valences on the aromatic ring system; and where R', R" and R"' are independently selected from hydrogen, $C_{1-8}$ alkyl, unsubstituted aryl and heteroaryl, (unsubstituted aryl)-$C_{1-4}$ alkyl, and unsubstituted aryloxy-$C_{1-4}$ alkyl.

As used herein, "polysaccharide" or "oligosaccharide" includes any compound having multiple monosaccharide units joined in a linear or branched chain. Polysaccharides include cellulose, starch, alginic acid, chytosan, or hyaluronan. In some embodiments, the term refers to long chains with hundreds or thousands of monosaccharide units. Some polysaccharides or oligosaccharides, such as cellulose have linear chains, while others (e.g., glycogen) have branched chains. Among the most abundant polysaccharides are starch and cellulose, which consist of recurring glucose units (although these compounds differ in how the glucose units are linked).

II. MICROFIBERS, NANOFIBERS AND COMPOSITES

The present invention provides thermoplastic polymer microfibers, nanofibers and composites. In one aspect, the present invention provides a thermoplastic polymer nanofiber having a diameter less than 1 μm and a predetermined or predefined cross-section. As used herein, the phrases "predetermined cross-section" and "predefined cross-section" are interchangeable. In some embodiments, the thermoplastic polymer is an isotactic or a syndiotactic poly(α-olefin). In certain other embodiments, the thermoplastic polymer is a copolymer of an isotactic or a syndiotactic poly(α-olefin). In one instance, the polymer is isotactic polypropylene. In another instance the polymer is synditactic polypropylene. In yet another instance, the polymer is a polyester or polyamide.

In another aspect, the present invention provides a thermoplastic polymer microfibrillar or nanofibrillar composite. In one embodiment, the composite includes a matrix; and a thermoplastic polymer microfiber embedded in the matrix, wherein the thermoplastic polymer microfiber has an average diameter less than about 10 μm and predetermined cross-section. In certain instances, the diameter of the microfiber is less than about 9, 8, 7, 6, 5, 4, 3, 2, 1, 0.9, 0.8, 0.7, 0.6 or 0.5 μm. In another embodiment, the composite includes a matrix; and a thermoplastic polymer nanofiber embedded in the matrix, wherein the thermoplastic polymer nanofiber has an average diameter less than about 1 μm and predetermined cross-section. In certain instances, the diameter of the nanofiber is less than about 900, 800, 700, 600, 500, 400, 300, 200 or 100 nm, preferably from about 10 nm to about 200 nm. In certain instances, the nanofibers have a diameter from about 70 nm to about 400 nm, such as about 75, 85, 95, 150, 200, 250, 275, 300, 325, 350, 375 nm.

Polymers useful in forming the microfibers include any melt-processable crystalline, semicrystalline or crystallizable polymers. Semicrystalline polymers comprise a mixture of amorphous regions and crystalline regions. The crystalline regions are more ordered and segments of the chains actually pack in crystalline lattices. Some polymers can be made semicrystalline by heat treatments, stretching or orienting, and by solvent inducement, and these processes can control the degree of true crystallinity. Semicrystalline polymers useful in the present invention include, but are not limited to, high and low density polyethylene, polypropylene, polyoxymethylene, poly(vinylidine fluoride), poly(methylpentene), poly(ethylene-chlorotrifluoroethylene), poly(vinyl fluoride), poly(ethylene oxide), poly(ethylene terephthalate) (PET), polytrimethylene terephthalate (PTT), polybutylene terephthalate (PBT), poly(butylene adipate terephthalate) (PBAT), poly(ethylene terephthalate-co-isophthalate)-poly(ethylene glycol) (IPET-PEG), a highly modified cationic ion-dyeable polyester (HCDP), polyamide, polyurethane, polycaprolactone, nylon 6, nylon-6,6, nylon 6, 12, polybutene, thermotropic liquid crystal polymers and a polymer having the formula:

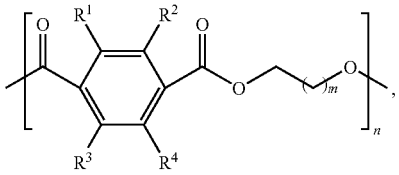

wherein R$^1$, R$^2$, R$^3$ and R$^4$ are each independently —H, a $C_{1-4}$alkyl, a $C_{1-4}$alkoxy, —OH, a halide, a $C_{1-6}$heteroalkyl, an aryl or a $C_{3-8}$heteroaryl; m is an independent integer from 1 to 5; and n is an integer from 1 to 2000. Examples of suitable thermotropic liquid crystal polymers include aromatic polyesters that exhibit liquid crystal properties when melted and which are synthesized from aromatic diols, aromatic carboxylic acids, hydroxycarboxylic acids, and other like monomers. Typical examples include a first type consisting of parahydroxybenzoic acid (PHB), terephthalic acid, and biphenol; and second type consisting of PHB and 2,6-hydroxynaphthoic acid; and a third type consisting of PHB, terephthalic acid, and ethylene glycol.

Useful polymers preferably are those that can undergo processing to impart a high orientation ratio in a manner that enhances their mechanical integrity, and are semi-crystalline in nature. Orienting semi-crystalline polymers significantly improves the strength and elastic modulus in the orientation direction, and orientation of a semicrystalline polymer below its melting point results in an oriented crystalline phase with fewer chain folds and defects. The most effective temperature range for orienting semicrystalline polymers is between the alpha crystallization temperature of the polymer and its melting point. The alpha crystallization temperature, or alpha transition temperature, corresponds to a secondary transition of the polymer at which crystal sub-units can be moved within the larger crystal unit.

Thermoplastic polymers can be used to form either the composite matrix or bulk phase. Thermoplastic polymers which can be used in the present invention include, but are not limited to, melt-processable polyolefins and copolymers and blends thereof, styrene copolymers and terpolymers (such as KRATON™), ionomers (such as SURLIN™), ethyl vinyl acetate (such as ELVAX™), polyvinylbutyrate, polyvinyl chloride, metallocene polyolefins (such as AFFINITY™ and ENGAGE™), poly(alpha olefins) (such as VESTOPLAST™ and REXFLEX™), ethylene-propylene-diene terpolymers, fluorocarbon elastomers (such as THV™ from 3M Dyneon), other fluorine-containing polymers, polyester polymers and copolymers (such as HYTREL™), polyamide polymers and copolymers, polyurethanes (such as ESTANE™. and MORTHANE™), polycarbonates, polyketones, and polyureas.

Preferred polymers in this aspect therefore are those that exhibit an alpha transition temperature ($T_\alpha$) and include, for example: high density polyethylene, linear low density polyethylene, ethylene alpha-olefin copolymers, polypropylene, poly(vinylidene fluoride), poly(vinyl fluoride), poly(ethylene chlorotrifluoroethylene), polyoxymethylene, poly(ethylene oxide), ethylene-vinyl alcohol copolymer, and blends thereof. Blends of one or more compatible polymers can also be used in practice of the invention. In the case of blends, it is not necessary that both components exhibit an alpha crystallization temperature. Particularly preferred polymers in this aspect have melting temperatures greater than 140° C. and blends of such polymers with lower temperature melting polymers. Polypropylene is one such polymer. Particularly preferred polymers are polyolefins such as polypropylene and polyethylene that are readily available at low cost and can provide highly desirable properties in the microfibrous articles used in the present invention, such properties including high modulus and high tensile strength.

Useful polyamide polymers include, but are not limited to, synthetic linear polyamides, e.g., nylon-6, nylon-6,6, nylon-11, or nylon-12. It should be noted that the selection of a particular polyamide material might be based upon the physical requirements of the particular application for the resulting reinforced composite article. For example, nylon-6 and nylon-6,6 offer higher heat resistant properties than nylon-11 or nylon-12, whereas nylon-11 and nylon-12 offer better chemical resistant properties. In addition to those polyamide materials, other nylon materials such as nylon-612, nylon-69, nylon-4, nylon-42, nylon-46, nylon-7, and nylon-8 may also be used. Ring containing polyamides, e.g., nylon-6T and nylon-61 may also be used. Polyether containing polyamides, such as PEBAX polyamides (Atochem North America, Philadelphia, Pa.), may also be used.

Polyurethane polymers which can be used include aliphatic, cycloaliphatic, aromatic, and polycyclic polyurethanes. These polyurethanes are typically produced by reaction of a polyfunctional isocyanate with a polyol according to well-known reaction mechanisms. Commercially available urethane polymers are also useful in the present invention.

Also useful are polyacrylates and polymethacrylates, which include, for example, polymers of acrylic acid, methyl acrylate, ethyl acrylate, acrylamide, methylacrylic acid, methyl methacrylate, n-butyl acrylate, and ethyl acrylate, to name a few.

Other useful substantially extrudable hydrocarbon polymers include polyesters, polycarbonates, polyketones, and polyureas. These materials are generally commercially available, for example: SELAR® polyester (DuPont, Wilmington, Del.); LEXAN® polycarbonate (General Electric, Pittsfield, Mass.); KADEL® polyketone (Amoco, Chicago, Ill.); and SPECTRIM® polyurea (Dow Chemical, Midland, Mich.).

Useful fluorine-containing polymers include crystalline or partially crystalline polymers such as copolymers of tetrafluoroethylene with one or more other monomers such as perfluoro(methyl vinyl)ether, hexafluoropropylene, perfluoro(propyl vinyl)ether; copolymers of tetrafluoroethylene with ethylenically unsaturated hydrocarbon monomers such as ethylene, or propylene.

Still other fluorine-containing polymers useful in the present invention include those based on vinylidene fluoride such as polyvinylidene fluoride; copolymers of vinylidene fluoride with one or more other monomers such as hexafluoropropylene, tetrafluoroethylene, ethylene, propylene, etc. Still other useful fluorine-containing extrudable polymers will be known to those skilled in the art as a result of this disclosure.

Polyolefins represent a class of extrudable polymers that are particularly useful in the present invention. Useful polyolefins include the homopolymers and copolymers of olefins, as well as copolymers of one or more olefins and other vinyl monomers and up to about 30 weight percent, but preferably 20 weight percent or less, of one or more monomers that are copolymerizable with such olefins, e.g., vinyl ester compounds such as vinyl acetate. The olefins have the general structure $CH_2{=}CHR$, where R is a hydrogen, an alkyl radical, an substituted alkyl or a heteroalkyl, and generally, the alkyl radical contains not more than 10 carbon atoms and preferably one to four carbon atoms. In one embodiment, the α-olefins have the general structure $CH_2{=}CHR$, where R is other than hydrogen. Representative olefins are ethylene, propylene, butylene, butene-1 and isotactic and syndiotactic isomers thereof. As used herein, the poly(α-olefin)s also include any copolymers formed from the polymerizing an α-olefin and one or more suitable monomers. Representative monomers which are copolymerizable with the olefins include 1-butene, 1-octene, 1-hexene, 4-methyl-1-pentene, propylene, vinyl ester monomers such as vinyl acetate, vinyl propionate, vinyl butyrate, vinyl chloroacetate, vinyl chloropropionate, acrylic and alpha-alkyl acrylic acid monomers, and their alkyl esters, amides, and nitriles such as acrylic acid, methacrylic acid, ethacrylic acid, methyl acrylate, ethyl acrylate, N,N-dimethyl acrylamide, methacrylamide, acrylonitrile, vinyl aryl monomers such as styrene, o-methoxystyrene, p-methoxystyrene, and vinyl naphthalene, vinyl and vinylidene halide monomers such as vinyl chloride, vinylidene chloride, vinylidene bromide, alkyl ester monomers of maleic and fumaric acid such as dimethyl maleate, diethyl maleate, vinyl alkyl ether monomers such as vinyl methyl ether, vinyl ethyl ether, vinyl isobutyl ether, 2-chloroethyl vinyl ether and vinyl pyridine monomers.

Representative examples of polyolefins useful in this invention are polyethylene, polypropylene, polybutylene, poly 1-butene, poly(3-methylbutene), poly(4-methylpentene) and copolymers of ethylene with propylene, 1-butene, 1-hexene, 1-octene, 1-decene, 4-methyl-1-pentene and 1-octadecene.

Representative blends of polyolefins useful in this invention are blends containing polyethylene and polypropylene, low-density polyethylene and high-density polyethylene, and polyethylene and olefin copolymers containing the copolymerizable monomers, some of which are described above, e.g., ethylene and acrylic acid copolymers; ethyl and methyl acrylate copolymers; ethylene and ethyl acrylate copolymers; ethylene and vinyl acetate copolymers-, ethylene, acrylic acid, and ethyl acrylate copolymers, and ethylene, acrylic acid, and vinyl acetate copolymers.

The preferred polyolefins are homopolymers of ethylene and propylene and copolymers of ethylene and 1-butene, 1-hexene, 1-octene, 4-methyl-1-pentene, propylene, vinyl acetate, and methyl acrylate. A preferred polyolefin is a homopolymer, copolymer, or blend of linear low-density polyethylene (LLDPE). Polyolefins can be polymerized using Ziegler-Natty catalysts, heterogeneous catalysts and metallocene catalysts.

Extrudable hydrocarbon polymers also include the metallic salts which contain free carboxylic acid groups. Illustrative of the metals which can be used to provide the salts of the carboxylic acid polymers are mono-, di-, tri, and tetravalent metals such as sodium, lithium, potassium, calcium, magnesium, aluminum, barium, zinc, zirconium, beryllium, iron, nickel and cobalt.

Carboxyl, anhydride, or imide functionalities may be incorporated into the hydrocarbon polymer within the present invention, by polymerizing or copolymerizing functional monomers, for example, acrylic acid or maleic anhydride, or by modifying a polymer after polymerization, for example, by grafting, by oxidation or by forming ionomers. These include, for example, acid modified ethylene vinyl acetates, acid modified ethylene acrylates, anhydride modified ethylene acrylates, anhydride modified ethylene vinyl acetates, anhydride modified polyethylenes, and anhydride modified polypropylenes. The carboxyl, anhydride, or imide functional polymers useful as the hydrocarbon polymer are generally commercially available. For example, anhydride modified polyethylenes are commercially available from DuPont, Wilmington, Del., under the trade designation BYNEL coextrudable adhesive resins.

Extrudable polymers also include polyesters. Polyesters are polymers containing multiple ester functional moieties in the polymer backbone. Polyesters are generally formed through condensation reaction, for example, by reacting a diacid with a diol. Polyesters can also be prepared by ring opening polymerization. Typical examples include a first type consisting of parahydroxbenzoic acid (PHB), terephthalic acid, and biphenol; and second type consisting of PHB and 2,6-hydroxynaphthoic acid; and a third type consisting of PHB, terephthalic acid, and ethylene glycol. Some examples of polyesters used in the present invention include, but are not limited to, poly(ethylene terephthalate) (PET), polytrimethylene terephthalate (PTT), polybutylene terephthalate (PBT), poly(butylene adipate terephthalate) (PBAT), poly(Ethylene terephthalate-co-isophthalate)-poly(ethylene glycol) (IPET-PEG), a highly modified cationic ion-dyeable polyester (HCDP), nylon 6, nylon—has a proton conductivity of about $10^{-5}\ \Omega^{-1}cm^{-1}$ or higher at the temperature of utilization has a proton conductivity of about $10^{-5}\ \Omega^{-1}cm^{-1}$ or higher at the temperature of utilization 6,6, nylon 6, 12.

The thermoplastic polymers can include blends of homo- and copolymers, as well as blends of two or more homo- or copolymers. Miscibility and compatibility of polymers are determined by both thermodynamic and kinetic considerations. Common miscibility predictors for non-polar polymers are differences in solubility parameters or Flory-Huggins interaction parameters. For polymers with non-specific interactions, such as polyolefins, the Flory-Huggins interaction parameter can be calculated by multiplying the square of the solubility parameter difference by the factor (V/RT), where V is the molar volume of the amorphous phase of the repeated unit $V=M/\Delta$ (molecular weight/density), R is the gas constant, and T is the absolute temperature. As a result, Flory-Huggins interaction parameter between two non-polar polymers is always a positive number. Thermodynamic considerations require that for complete miscibility of two polymers in the melt, the Flory-Huggins interaction parameter has to be very small (e.g. less than 0.002 to produce a miscible blend starting from 100,000 weight-average molecular weight components at room temperature). It is difficult to find polymer blends with sufficiently low interaction parameters to meet the thermodynamic condition of miscibility over the entire range of compositions. However, industrial experiences suggest that some blends with sufficiently low Flory-Huggins interaction parameters, although still not miscible based on thermodynamic considerations, form compatible blends.

Preferred thermoplastic polymers include polyamides, polyimides, polyurethanes, polyolefins, polystyrenes, aromatic polyesters, polycarbonates, polyketones, polyureas, polyvinyl resins, polyacrylates and polymethacrylates. Most preferred thermoplastic polymers include polyolefins, polystyrenes, and aromatic polyesters, because of their relatively low cost and widespread use. For example, tactic poly(α-olefin)s, such as polypropylene.

The thermoplastic polymers can be used in the form of powders, pellets, granules, or any other melt-processable form. The particular thermoplastic polymer selected for use will depend upon the application or desired properties of the finished product. The thermoplastic polymer may be combined with conventional adjuvants such as light stabilizers, fillers, staple fibers, antiblocking agents and pigments.

The matrix phase can be an elastomeric polymer in one embodiment, a thermoset polymer in another embodiment, a thermoplastic polymer in yet another embodiment, and a thermoplastic elastomeric polymer in still another embodiment. A preferred matrix material in one embodiment is formed of thermoplastic, elastomeric syndiotactic polypropylene. A more preferred matrix material includes a cellulose $C_{1-8}$alkanoate, cellulose arenoate, such as cellulose benzoate, a cellulose $C_{1-8}$alkylated, a cellulose $C_{1-8}$heteroalkylated, cellulose acetate, cellulose acetate butyrate, polysaccharides, starch, starch derivatives and combinations thereof. In one embodiment, the butyrate content is about 5% to about 90%, preferably from 10% to about 70%, more preferably from 15% to about 60%, even more preferably from about 17% to about 50%. In another embodiment, the butyrate and acetate has a weight ratio from about 100:1 to about 1:100. The thermoplastic polymer and the matrix material can have a ratio from about 100:1 to about 1:100, preferably, from about 40:1 to 1:40, more preferably from about 30:1 to about 1:30, even more preferably, from 20:1 to about 1:20; still even more preferably from 10:1 to 1:10; most preferably from 3:2 to about 2:3.

The microfibers generally have an effective average diameter less than about 20 microns, preferably less than 10 microns, and can have an effective average diameter ranging from about 0.5 microns to about 10 microns, for example, from 0.5 to 1 μm, 0.5 to 5 μm, 0.5-10 μm, 1 to 5 μm and from 1 to 10 μm. The nanofibers can have an average diameter from 10 nm to about 500 nm, from about 10 nm to about 400 nm, from about 10 nm to about 300 nm, from about 10 nm to about 200 nm or from 10 nm to about 100 μm. The microfibers and nanofibers can have cross-sections with various regular and irregular shapes including, but not limiting to circular, oval, square, rectangular, triangular, diamond, trapezoidal and polygonal. The number of sides of the polygonal cross-section may vary from 3 to about 16. One example is a four-sided polygon such as a square or rectangle. In one embodiment, the cross-sections are substantially rectangular. substantially rectangular microfibers, the effective diameter may be a measure of the average value of the width and thickness of the fibers. Some microfibers with a rectangular cross-section have a transverse aspect ratio of from 1:1 to 20:1, such as 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, while other microfibers have a transverse aspect ratio of between about 3:1 to 9:1. The Transverse Aspect Ratio may be defined as the ratio of width to thickness. In another embodiment, the microfibers have substantially circular cross-sections. In some embodiments, the microfibers can have an average cross sectional area of between about 0.5 and 3.0 square microns. In some embodiments, the microfibers can have an average cross sectional area of between about 0.7 and 2.1 square microns. Atomic force microscopy reveals that the microfibers of the present invention are bundles of individual or unitary fibrils, which in aggregate form the rectangular or ribbon-shaped microfibers. Thus, the surface area exceeds that which may be expected from rectangular shaped microfibers, and such surface enhances bonding in thermoset and thermoplastic matrices. Preferably, the microfibers and nanofibers of the invention have a predetermined or predefined cross-section of defined shapes and dimensions. In some embodiments, the microfibers and nanofibers have a uniformed cross-section. In certain embodiments, the microfibers or nanofibers have a circular predetermined cross-section and an area of between 0.3 and 5 square microns, such as 0.4, 0.5, 0.6, 0.7, 0.8, 0.9, 1, 2, 3, 4 or 5 square microns. In certain other embodiments, the nanofibers have a circular predefined cross-section and an area of between about 100 and about 160000 or between about 400 and about 40000 square nanometers, such as 200, 300, 400, 500, 600, 700, 800, 1000, 2000, 3000, 4000, 5000, 6000, 7000, 8000, 9000, 10000, 20000, 30000, 40000, 50000, 60000, 70000, 80000, 90000, 100000, 110000, 120000, 130000, 140000, 150000, 160000 square nanometers.

The microfibers can have a surface area greater than about 0.25 square meters per gram, typically about 0.5 to about 30 square meters per gram, preferably at least 3 square meters per gram. One embodiment includes microfibers having a surface area of at least about 5 square meters per gram. The microfibers may also have a very high modulus. In one example, polypropylene fibers used in the present invention can have a modulus greater than $10^9$ Pascal.

In yet another embodiment, the fully or partially microfibrillated article is cut into strips having a microfibrous surface, i.e. having microfibers or microfibrous flakes protruding therefrom and embedded into the polymer matrix. One embodiment forms microfibrous strips having a preselected width, for example, of about 100 microns or less. Generally, the strips of microfibrillated article microfibrillated article strips have an average width of between about 1.5 and $4\times10^8$ times the average cross sectional area of the microfibers.

In still another embodiment, the one or two sided, partially or totally microfibrillated composite is processed into a pulp and embedded into the polymer matrix. One suitable processing method includes feeding the microfibrillated article through a carding machine. One other method includes collecting loose microfibers harvested from a microfibrillated article, for example, by scraping the microfibers from the film surface using a knife-edge. One method further processes the microfibers, which can be produced using the methods described above.

III. METHODS

In one aspect, the present invention provides a method for preparing a microfibrillar composite. The method includes admixing a thermoplastic polymer and a matrix material to form a mixture, wherein the thermoplastic polymer and the matrix material are thermodynamically immiscible; and extruding the mixture under conditions sufficient to form a microfibrillar composite, wherein the composite comprises a plurality of the thermoplastic polymer microfibers embedded in the matrix material.

In another aspect, the present invention provides a method for preparing a microfiber. The method includes admixing a thermoplastic polymer and a matrix material to form a mixture, wherein the thermoplastic polymer and the matrix material are thermodynamically immiscible; extruding the mixture under conditions sufficient to form a microfibrillar composite, wherein the composite comprises a plurality of the thermoplastic polymer microfibers embedded in the matrix material; and removing the matrix material to form a thermoplastic polymer microfiber.

In yet another aspect, the present invention provides a method for preparing a nanofibrillar composite. The method includes admixing a thermoplastic polymer and a matrix material to form a mixture, wherein the thermoplastic polymer and the matrix material are thermodynamically immiscible; and extruding the mixture under conditions sufficient to form a nanofibrillar composite, wherein the composite comprises a plurality of the thermoplastic polymer nanofibers embedded in the matrix material.

In still another aspect, the present invention provides a method for preparing a nanofiber. The method includes admixing a thermoplastic polymer and a matrix material to form a mixture, wherein the thermoplastic polymer and the matrix material are thermodynamically immiscible; extruding the mixture under conditions sufficient to form a nanofibrillar composite, wherein the composite comprises a plurality of the thermoplastic polymer nanofibers embedded in the matrix material; and removing the matrix material to generate a thermoplastic polymer nanofiber.

In one embodiment, a mixture of thermoplastic polymer and a matrix is prepared by dry-mix at a weight ratio from about 100:1 to 1:100, about 98:5 to about 5:95, 90:10 to about 10:90 and 80:20 to about 20:80. In one instance, a matrix, such as CAB and a thermoplastic polymer, such as iPP are mixed at a weight ratio of about 97.5 to 2.5. The mixture is extruded through a die at a temperature below the thermal degradation temperature of the polymer and the matrix material, for example, at about 240-260° C. The extrudates can be hot-drawn using a drawing device. In another embodiment, a polymeric film is extruded from the melt through a die in the form of a film or sheet. The extruded film can be quenched to maximize the crystallinity of the film by retarding or minimizing the rate of cooling. The quenching preferably occurs to not only maximize the crystallinity, but to maximize the size of the crystalline spherulites.

In some embodiments, CAB/iPP, CAB/HDPE, CAB/PET, CAB/PTT, CAB/PBT and CAB/IPET-PEG melt blends with a weight ratio of about 1:100 to about 100:1 are prepared by general round capillary die extrusion and either after a drawing or before a drawing process. The microfibers formed have a minimum dimension from about 0.1 to about 0.4 μm.

In other embodiments, a second melt extrusion is applied to the extruded blends. During the second melt extrusion process of pelletized CAB/Thermoplastics blends at a temperature, which is the same as the first extrusion temperature, the microfibrils already formed of minor phases do not relax and return to the stable spherical morphology, they have experienced elongation again passing through the die, which led to a smaller average diameters and narrower diameter distributions of microfibrils with comparison of the drawn and not hot drawn blends.

In one embodiment, the film is calendered after quenching. Calendering allows higher molecular orientation to be achieved by enabling subsequent higher draw ratios. After calendering, the film can be oriented uniaxially in the machine direction by stretching the film to impart a microvoided surface thereto under conditions of plastic flow that are insufficient to cause catastrophic failure of the film. In one example, using polypropylene, the film may be stretched at least 5 times its length. In a preferred embodiment, when considering both calendering and stretching, the combined draw ratio is at least about 10:1. In one embodiment, the preferred draw ratio is between about 10:1 and 40:1 for polypropylene.

The stretching conditions are chosen such that microvoids are imparted in the film surface. The film or material to be microvoided is preferably stretched at a rate sufficiently fast or at a temperature sufficiently low, such that the polymer, of which the film or material is comprised, is unable to conform to the imposed deformation while avoiding catastrophic failure of the film or material. The highly oriented, highly crystalline film with microvoids may then be subject to sufficient fluid energy to the surface to release the microfibers from the microvoided film or material.

In a preferred embodiment, microfiber and nanofiber composites can be prepared by admixing a thermoplastic polymer and a matrix material to form a mixture, wherein the thermoplastic polymer and the matrix material are thermodynamically immiscible; and extruding the mixture under the above conditions to form a microfibrillar or a nanofibrillar composite, wherein the composite comprises a plurality of the thermoplastic polymer microfibers or nanofibers embedded in the matrix material.

In another preferred embodiment, microfibers and nanofibers can be prepared by admixing a thermoplastic polymer and a matrix material to form a mixture, wherein the thermoplastic polymer and the matrix material are thermodynamically immiscible; and extruding the mixture under conditions sufficient to form a microfibrillar or a nanofibrillar composite, wherein the microfibrillar or the nanofibrillar composite comprises a thermoplastic polymer microfiber or nanofiber having a diameter less than 10 μm or less than 1 μm and embedded in the matrix material. Subsequent removal of the matrix material generates a thermoplastic polymer microfiber or nanofiber. In one embodiment, the matrix material can be removed by dissolving the material in a solvent. The solvent can be an organic solvent, a aqueous solution or a mixture thereof. Preferably, the solvent is an organic solvent. Examples of solvents include, but are not limited to, acetone, alcohol, chlorinated solvent, tetrahydrofuran, dimethylsulfoxide, amides and mixtures thereof. Exemplary alcohol solvents include, but are not limited to, methanol, ethanol, isopropanol and the like. Exemplary chlorinated solvents include, but are not limited to, methylene chloride, chloroform, carbontetrachloride, dichloroethane and the like. Exemplary amide solvent include, but are not limited to, dimethylformamide, dimethylacetamide and the like.

In a preferred embodiment, the thermoplastic polymers and matrix are thermodynamically immiscible. Preferably, the thermoplastic polymers and the matrix form a plurality of separated micro phases. Miscibility of polymers is determined by both thermodynamic and kinetic considerations. Common miscibility predictors for non-polar polymers are differences in solubility parameters or Flory-Huggins interaction parameters. For polymers with non-specific interactions, such as polyolefins, the Flory-Huggins interaction parameter can be calculated by multiplying the square of the solubility parameter difference with the factor (V/RT), where V is the molar volume of the amorphous phase of the repeated unit, R is the gas constant, and T is the absolute temperature. As a result, Flory-Huggins interaction parameter between two non-polar polymers is always a positive number.

Polymers useful as the void-initiating component include semicrystalline polymers, as well as amorphous polymers, selected so as to form discrete phases upon cooling from the melt. Useful amorphous polymers include, but are not limited to, polystyrene, polymethylmethacrylate, polyethylene and polypropylene.

The immiscible mixture of a first polymer component and a matrix component is extruded from the melt through a die in the form of a film, sheet or bundle and quenched to maximize the crystallinity of the semicrystalline phase by retarding or minimizing the rate of cooling. It is preferred that the crystallinity of the semicrystalline polymer component be increased by an optimal combination of casting and subsequent processing such as calendering, annealing, stretching and recrystallization. It is believed that maximizing the crystallinity of the film will increase microfibrillation efficiency.

In one microfibrillation method, a high-pressure fluid is used to liberate the microfibers from the film. A water jet is a preferred device for liberating microfibers in some embodiments. In this process one or more jets of a fine fluid stream impact the surface of the polymer film, which may be supported by a screen or moving belt, thereby releasing the microfibers from the polymer matrix. One or both surfaces of the film may be microfibrillated. The degree of microfibrillation is dependent on the exposure time of the film to the fluid jet, the pressure of the fluid jet, the cross-sectional area of the fluid jet, the fluid contact angle, the polymer properties and, to a lesser extent, the fluid temperature. Different types and sizes of screens can be used to support the film.

Any type of liquid or gaseous fluid may be used. Liquid fluids may include water or organic solvents such as ethanol or methanol. Suitable gases such as nitrogen, air or carbon dioxide may be used, as well as mixtures of liquids and gases. Any such fluid is preferably non-swelling (i.e., is not absorbed by the polymer matrix), which would reduce the orientation and degree of crystallinity of the microfibers. Preferably the fluid is water. The fluid temperature may be elevated, although suitable results may be obtained using ambient temperature fluids. The pressure of the fluid should be sufficient to impart some degree of microfibrillation to at least a portion of the film, and suitable conditions can vary widely depending on the fluid, the nature of the polymer, including the composition and morphology, configuration of the fluid jet, angle of impact and temperature. Typically, the fluid is water at room temperature and at pressures of at least 3400 kPa (500 psi), although lower pressure and longer exposure times may be used. Such fluid will generally impart a minimum of 10 $W/cm^2$ based on calculations assuming incompressibility of the fluid, a smooth surface and no losses due to friction.

The present invention also provides a method for producing sea and island microfibers or nanofibers. In one embodiment, the method includes spinning the island polymer and sea polymer to obtain a fiber. The spinning procedure in accordance with the present invention comprises mixed spinning the island polymer and sea polymer in a weight ratio ranging from about 5:95 to 70:30 into the fiber or conjugate spinning the island polymer and sea polymer in a weight ratio ranging from about 5:95 to 95:5 into the fiber. The so-called mixed spinning method pertains to mixing the sea polymer and island polymer, melting the polymers in the same extruder, and extruding the polymers through a spinneret to produce yarns. The so-called conjugate spinning method pertains to mixing and melting the sea polymer and island polymer in different extruders and combining the two polymers at a spinneret as yarns. The fiber thus obtained preferably has fineness ranging from about 1 to about 15 denier per filament and the number of the islands in the fiber preferably ranges from about 6 to about 5000. Suitable island polymer for the subject invention includes polypropylene, polyethylene, ethylene-propylene copolymer, polyester and polyolefin elastomer polymer. In another embodiment, admixing a thermoplastic polymer and a matrix material to form a mixture, wherein the thermoplastic polymer and the matrix material are thermodynamically immiscible; and extruding the mixture under conditions sufficient to form a microfibrillar or a nanofibrillar composite having a sea-island structure.

The polypropylene includes polypropylene homopolymer, polypropylene random copolymer, or polypropylene block copolymer. The polyethylene includes low-density polyethylene, medium-density polyethylene, high-density polyethylene or linear low-density polyethylene polymer. The copolymers of polypropylene are either obtained from a commercial supplier or prepared using conventional methods known to a person of skill in the art. For example, the polypropylene copolymers are prepared by polymerizing propylene and a vinyl monomer using a radical initiator, such as AIBN or BPO at a temperature between 50-100° C. The tactic polypropylene copolymer can be prepared using a Ziegler-Natta catalyst, such as a group 4 metallocene catalyst (e.g. a zirconocene catalyst) at a temperature between −78-22° C. The choice of reaction conditions are within the abilities of those skilled in the art. The polymers can be isolated and purified by precipitation in a solvent, such as methanol.

The materials suitable for the sea polymer can be selected from (a) solvent-soluble polymer, for example, polystyrene, polyethylene, cellulose, cellulose acetate, cellulose acetate butyrate, cellulose acetate alkanote, polysaccharides, starch and starch derivatives. (b) alkali-soluble sulfonic sodium containing polyethyleneterephthalate and derivatives thereof, (c) water-soluble polyvinyl alcohol or water-soluble polyester copolymer comprising isopropyl alcohol (IPA), terephthalic acid (TPA), acrylic acid (AA), sulfonic sodium salt (SIP), and polyethyleneglycol (PEG).

The method for producing a microfiber or a nanofiber fabric includes producing a woven or a nonwoven fabric or fabric substrate from the above-mentioned sea and island fiber and dissolving and removing the sea polymer of the substrate so as to obtain a microfiber or a nanofiber substrate. The island polymer obtained from the selected polyolefin or polyester polymer has low density and high flexural modulus properties. With the same weight per area, the substrate of the subject invention is thicker than that of conventional substrates made of nylon or polyester fiber as an island polymer. Due to high flexural modulus property of the island polymer obtained from the selected polyolefin polymer, the thickness reducing ratio of the substrate obtained from dissolving and removing the sea polymer in accordance with the subject invention is less than that of the conventional substrates. Hence, the weight of the woven or nonwoven fabric or fabric substrate in accordance with the subject invention can be considerably reduced. The desired thickness of the final products can still be obtained after dissolving and removing the sea polymer.

The microfibers can be formed into a woven or a nonwoven mat by forming the microfibers on a scrim or screen to provide a porous surface on which to form the woven or the non-woven mat and embedded into the polymer matrix. Microfibers can also be formed into mats or preforms by stacking or layering microfibrous mats, preferably with the major fiber axis orientation in each mat being biased relative to that of an adjacent mat. The construction of the laminate and the orientation or bias of each fiber layer may be determine by performance requirements, as is known to one skilled in the art. Entangling fibers between layers can be of further use by forming a mechanical bond between layers and thereby reducing or eliminating delamination between layers in the ultimate composite. Further, altering the major fiber axis, or biasing, the adjacent layers provides additional tensile strength along the different axes.

Hybrid mats or hybrid preforms containing more than one microfiber type or containing both microfibers and engineering fibers can be made and used advantageously in the present invention. Engineering fibers are characterized by their high tensile modulus and/or tensile strength. Engineering fibers include, but are not limited to, E-glass, S-glass, boron, ceramic, carbon, graphite, aramid, poly(benzoxazole), ultra high molecular weight polyethylene (UHMWPE), and liquid crystalline thermotropic fibers. In one embodiment of hybrid mats or hybrid preforms each layer or ply consists of a single fiber type. In another embodiment of hybrid mats or hybrid preforms, each ply consists of two or more fiber types. Entangling fibers between layers in hybrid mats or preforms can also provide the advantages described above.

The use of hybrid mats or hybrid preforms in composites can impart properties that cannot be realized with a single fiber type. For example, the high stiffness imparted by an engineering fiber can be combined with the low density and toughness imparted by the microfibers. The extremely large amount of interfacial area of the microfibers can be effectively utilized as a means to absorb and dissipate energy, such as that arising from impact. In one embodiment a microfiber mat comprised of hydrophobic microfibers is placed at each of the outermost major surfaces of the hybrid mat, thereby forming a moisture barrier for the inner layers. This is especially advantageous when the inner layers are comprised of relatively hydrophilic fibers such as glass.

Formation Mechanism of Microfibrillar Morphology

Without intending to be bound by any particular theory, the highly elongated morphology of the dispersed phase obtained after melt blending is considered as an overall result of, for example, i) breakup, ii) single particle deformation or iii) coalescence of dispersed phase in matrix melt and combinations thereof [M. J. Folkes and P. S. Hope, *Polymer blends and alloys*, London, New York: Blackie Academic & Professional, 1993; R. Gonzalez Nunez et al., *Journal of Applied Polymer Science,* 62:1627-1634 (1996); R. Gonzalez Nunez and D. De Kee, *Polymer,* 37:4689-4693 (1996)]. It is generally believed that the major factors governing the above three processes include blend composition, viscosity ratio $\eta_d/\eta_m$, interfacial tension and processing parameters [M. J. Folkes and P. S. Hope, *Polymer blends and alloys*, London, New York: Blackie Academic & Professional, 1993]. Viscosity ratio and capillarity number are most often used to estimate the morphology of the dispersed phase [Q. Xing et al., *Polymer,* 46:5406-5416 (2005)]. These two equations, however, are derived from Newtonian liquid systems and do not take into account the coalescence process that is essential in the formation of the microfibrillar morphology of the dispersed phase [M. J. Folkes and P. S. Hope, *Polymer blends and alloys*, London, New York: Blackie Academic & Professional, 1993; M. A. Huneault et al., *Polymer Engineering and Science,* 35:115-127 (1995)]. The empirical rules concluded by some investigators to obtain the microfibrillar morphology are the existence of an elongational flow field and a small viscosity ratio (i.e. $\eta_d/\eta_m<1$) [Hui Quan et al., *Polymer Engineering and Science,* 45:1303-1311 (2005); Z. M. Li et al., *Materials Research Bulletin,* 37:2185-2197 (2002); H. S. Xu et al., *Macromolecular Materials and Engineering,* 289: 1087-1095 (2004); Q. Xing et al., *Polymer,* 46:5406-5416 (2005); B. K. Kim and I. H. Do, *Journal of Applied Polymer Science,* 60:2207-2218 (1996)]. However, in some cases with a viscosity ratio above one, in situ microfibrillar morphology can still form under hot stretching condition [H. S. Xu et al., *Macromolecular Materials and Engineering,* 289:1087-1095 (2004)].

It is well known that when the melt flows through the entrance of the capillary die, the melt undergoes an elongation flow field because of the convergence effect at the entrance. The fact that the microfibrillar and lamellar hybrid morphology can form whether extruded CAB/Thermoplastics blends are drawn at the die exit or not suggests that the die entrance and the capillary die are the major places to form the microfibrillar and lamellar hybrid morphology, and the elongation flow field would be of great importance to the morphology evolution.

As shown in FIG. 1A, without being bound by any particular theory, the formation mechanism of microfibrillar and lamellar morphology can be proposed as follows. First, the thermoplastics of minor phases can breakup into smaller spherical particles with different diameters depending on the interfacial tension and viscosity ratio of minor phases to major phases. Then the particles with different sizes experienced elongation flow field and are deformed into the ellipsoid when they went close to and through the die entrance. Inside the capillary die, the elongated ellipsoids continuously undergo the elongation stress and are further elongated, and then the nearby highly elongated ellipsoid coalesces each other. Finally, the continuous and well developed microfiber or lamellar are formed at the die exit. In addition, the formation of lamella is the result of the coalescence of the adjacent microfibrils.

Since the sizes of the elongated ellipsoids were different for different blend systems with different viscosity ratio and interfacial tension, the probability of contact and coalescence efficiency were different, which caused the broader or narrower diameter distribution. The interfacial adhesion for CAB/polyester blends because of the presence of the dipole-dipole interaction is higher than that for CAB/polyolefin blends. The stress applied to matrix CAB can not be effectively transferred to the minor phases of polyolefin, compared to the minor phases of polyester, which results in a broader distribution of particles of polyolefin phases and different coalescence probability. As a result, CAB/polyolefin blends had a broader diameter distribution of microfibers. It seems like the study on the effect of viscosity ratio on the morphology of microfibers should be conducted in the blend systems with similar interfacial adhesion between the blend components. Thus it can be readily explained that the CAB/PBT blends with a viscosity ratio of 6.5 or higher possessed the broadest diameter distribution among the CAB/polyester blends.

During the hot drawing process of as extruded rods, the gradual reduction in width and increase in length of the extruded rods led to the decrease in diameter of the microfiber and narrowed the diameter distribution. When the pelletized CAB/iPP, CAB/HDPE, CAB/PET and CAB/PTT in situ microfibrillar and lamellar hybrid blends were melt extruded again, it is more likely that the formed microfiber and lamella did not completely collapsed and relaxed to the spherical form, the microfibrillar and lamellar structure remained to some extent and experienced further elongation passing through the die, which caused the microfibers reoriented along the longitudinal direction of the die and then coalesced together. As a result, the well defined microfibrillar and lamellar hybrid with smaller average diameters of microfiber and narrower distributions were prepared.

IV. APPLICATION OF MICROFIBERS AND NANOFIBERS

The present invention also contemplates the use of microfibers and nanofibers in the fabrication of biocidal textiles, in the manufacturing and use as biosensors, membranes, filters, protein support and as scaffolds for organ repairs.

Due to their extremely small porous dimensions and high surface to volume ratio, nanofibers can be utilized as substrates for many applications such as high performance waste water filtration or biological contaminants filtration membranes. The average dimension of nanofibers is less than 500 nm, in some instances, less than 300 nm, in certain instances, less than 200 nm, in certain other instances, less than 100 nm, and yet certain other instances, as small as 20 or 10 nm.

In one embodiment, the microfibers and nanofibers of the present invention can improve the properties of existing polymer composites and films by providing a microfiller-reinforced polymer composites and films, and corresponding fabrication process, that has a reduced coefficient of thermal expansion, increased elastic modulus, improved dimensional stability, and reduced variability of properties due to either process variations or thermal history. Additionally, the increased stiffness of the material due to the microfiber or nanofiber and corresponding reduction in required film thickness and weight to meet given stiffness or strength requirements.

The nanofibers of the present invention can be used in many known applications employing nanofibers including, but not limited to, filter applications, computer hard drive applications, biosensor applications and pharmaceutical applications. The nanofibers are useful in a variety of biological applications, including cell culture, tissue culture, and tissue engineering applications. In one application, a nanofibrillar structure for cell culture and tissue engineering may be fabricated using the nanofibers of the present invention.

In one application, a growth media for cell culture may be prepared using the improved nanofiber. In an embodiment, the growth media comprises a matrix of nanofibers in the form of a mat, roll, or sheet that may be adapted for insertion into a culture container. In another embodiment, the growth media comprises a matrix of nanofibers that is deposited onto a surface of a culture container or added as a fibrous mesh to the culture container.

In another application, the nanofibers can be sprayed or spun onto a three-dimensional structure suitable for cell or tissue culture. The resultant three-dimensional structure is returned to a cell culture apparatus for continued growth where the electrospun fiber structure serves as a platform for growth of the cells. In a further application, the nanofibers may be electrospun into nonwoven mesh and/or braids for the layered construction of three-dimensional matrices to serve as templates for tissue regeneration. In a further application, the nanofibers can be used as a cell culture medium in high throughput drug analysis and drug sensitivity analysis to increase the number of cells per well providing higher signal for detection of cell response. In another further application, the improved nanofibers can be used as a cell culture medium in high throughput drug analysis, drug sensitivity analysis, and other therapeutic schemes where the nanofibers provide an environment for the cells to more closely mimic the in vivo nature of the cells in an ex vivo environment.

Another aspect of the invention is the utility of microfiber or nanofiber materials formed into a filter structure. In one embodiment, the present invention provides a method of manufacturing of a filter media. The method includes depositing a layer of thermoplastic nanofibers having a defined diameter on a substrate. In such a structure, the fine fiber materials of the invention are formed on and adhered to a filter substrate. Natural fiber and synthetic fiber substrates, like spunbonded fabrics, non-woven fabrics of synthetic fiber and non-wovens made from the blends of cellulosics, synthetic and glass fibers, non-woven and woven glass fabrics, plastic screen like materials both extruded and hole punched, ultra fine and medium fine membranes of organic polymers can be used. Sheet-like substrate or cellulosic non-woven web can then be formed into a filter structure that is placed in a fluid stream including an air stream or liquid stream for the purpose of removing suspended or entrained particulate from that stream. The shape and structure of the filter material is up to the design engineer. One important parameter of the filter elements after formation is its resistance to the effects of heat, humidity or both. One aspect of the filter media of the invention is a test of the ability of the filter media to survive immersion in warm water for a significant period of time. The immersion test can provide valuable information regarding the ability of the fine fiber to survive hot humid conditions and to survive the cleaning of the filter element in aqueous solutions that can contain substantial proportions of strong cleaning surfactants and strong alkalinity materials. Preferably, the fine fiber materials of the invention can survive immersion in hot water while retaining at least 50% of the fine fiber formed on the surface of the substrate. Retention of at least 50% of the fine fiber can maintain substantial fiber efficiency without loss of filtration capacity or increased back pressure. Most preferably retaining at least 75%.

The polymer composite materials of the present invention have improved physical and chemical stability. The polymer fine fiber (microfiber and nanofiber) can be fashioned into useful product formats. Nanofibers of various dimensions can be prepared using the method of the present invention. In some embodiments, the nanofibers have a diameter less than about 500, 400, 300, or 200 nm. The microfibers typically have a diameter larger than 0.5 micron, but not larger than 10 microns. These fine fibers can be made in the form of an improved multi-layer microfiltration media structure. The fine fiber layers of the invention comprise a random distribution of fine fibers which can be bonded to form an interlocking net. Filtration performance is obtained largely as a result of the fine fiber barrier to the passage of particulate. Structural properties of stiffness, strength, pleatability are provided by the substrate to which the fine fiber adhered. The fine fiber interlocking networks have as important characteristics, fine fibers in the form of microfibers or nanofibers and relatively small spaces between the fibers. Such spaces typically range, between fibers, of about 0.01 to about 25 microns or often about 0.1 to about 10 microns. The filter products comprising a fine fiber layer and a cellulosic layer are thin with a choice of appropriate substrate. The fine fiber adds less than a micron in thickness to the overall fine fiber plus substrate filter media. In service, the filters can stop incident particulate from passing through the fine fiber layer and can attain substantial surface loadings of trapped particles. The particles comprising dust or other incident particulates rapidly form a dust cake on the fine fiber surface and maintains high initial and overall efficiency of particulate removal. Even with relatively fine contaminants having a particle size of about 0.01 to about 1 micron, the filter media comprising the fine fiber has a very high dust capacity.

The polymer microfiber and nanofiber materials as disclosed herein have substantially improved resistance to the undesirable effects of heat, humidity, high flow rates, reverse pulse cleaning, operational abrasion, submicron particulates, cleaning of filters in use and other demanding conditions. Further, the filter media of the invention using the polymeric materials of the invention provides a number of advantageous features including higher efficiency, lower flow restriction, high durability (stress related or environmentally related) in the presence of abrasive particulates and a smooth outer surface free of loose fibers or fibrils. The overall structure of the filter materials provides an overall thinner media allowing improved media area per unit volume, reduced velocity through the media, improved media efficiency and reduced flow restrictions.

In another aspect, the present invention provides a use of thermoplastic polymer nanofiber for protein support or as scaffolds for organ repair. The embodiments of the current invention also comprise various medical devices, such as clamps, valves, intracorporeal or extracorporeal devices (e.g., catheters), temporary or permanent implants, stents, vascular grafts, anastomotic devices, aneurysm repair devices, embolic devices, and implantable devices (e.g., orthopedic implants) and the like which comprise nanofiber enhanced surfaces. Such enhanced surfaces provide many enhanced attributes to the medical devices in, on, or within which they are used including, e.g., to prevent/reduce bio-fouling, increase fluid flow due to hydrophobicity, increase adhesion, biointegration, etc.

V. EXPERIMENTS AND EXAMPLES

Materials

Cellulose acetate butyrate (CAB; butyryl content 35-39%) was purchased from the Acros Chemical Co., Isotactic polypropylene (iPP), was obtained in the form of granule by Exxon Mobile Co., LDPE and HDPE pellets were commercial products purchased from Aldrich Chemicals Co., Commercial grade poly(trimethylene terephthalate) (PTT), PBT and PET pellets were kindly supplied by Shell Chemicals L P, USA, Ticona Engineering Polymers and Wellman, Inc, respectively. IPET-PEG and HCDP pellets were supplied by Dong Hua University, Shanghai, China. Poly[ethylene-co-(glycidyl methacrylate)] (PE-co-GMA) was supplied by Exxon mobile, Shell Chemicals and Aldrich Chemical Company. The polymers used in this study were dried prior to mixing and melt blending.

Example 1

Melt Mixing

Mixtures of CAB with iPP, HDPE, PET and PTT at the weight ratio of 80/20 were blended in a mixer (ATR Plasti-Corder®, C. W. Brabender, USA) for 5 min. The screw speed was 100 rpm. The temperature was 240° C. for CAB/iPP, CAB/HDPE as well as CAB/PTT blends and 260° C. for CAB/PET blend, respectively.

Extrusion of CAB/Thermoplastics

Figure 1B:
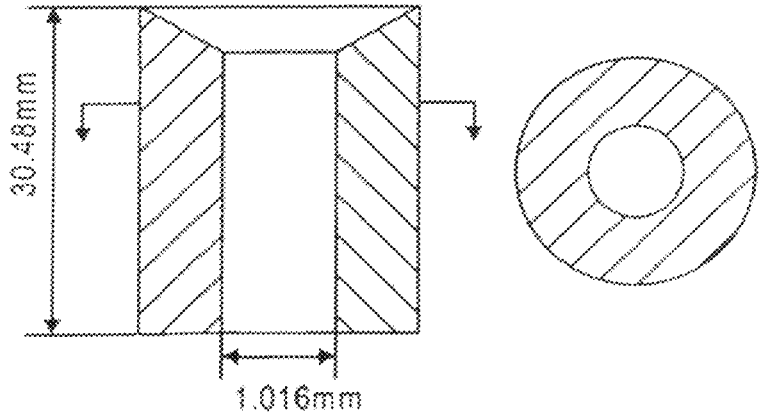
FIG. 1B illustrates shape and dimensions of a capillary die.
Figure 2:
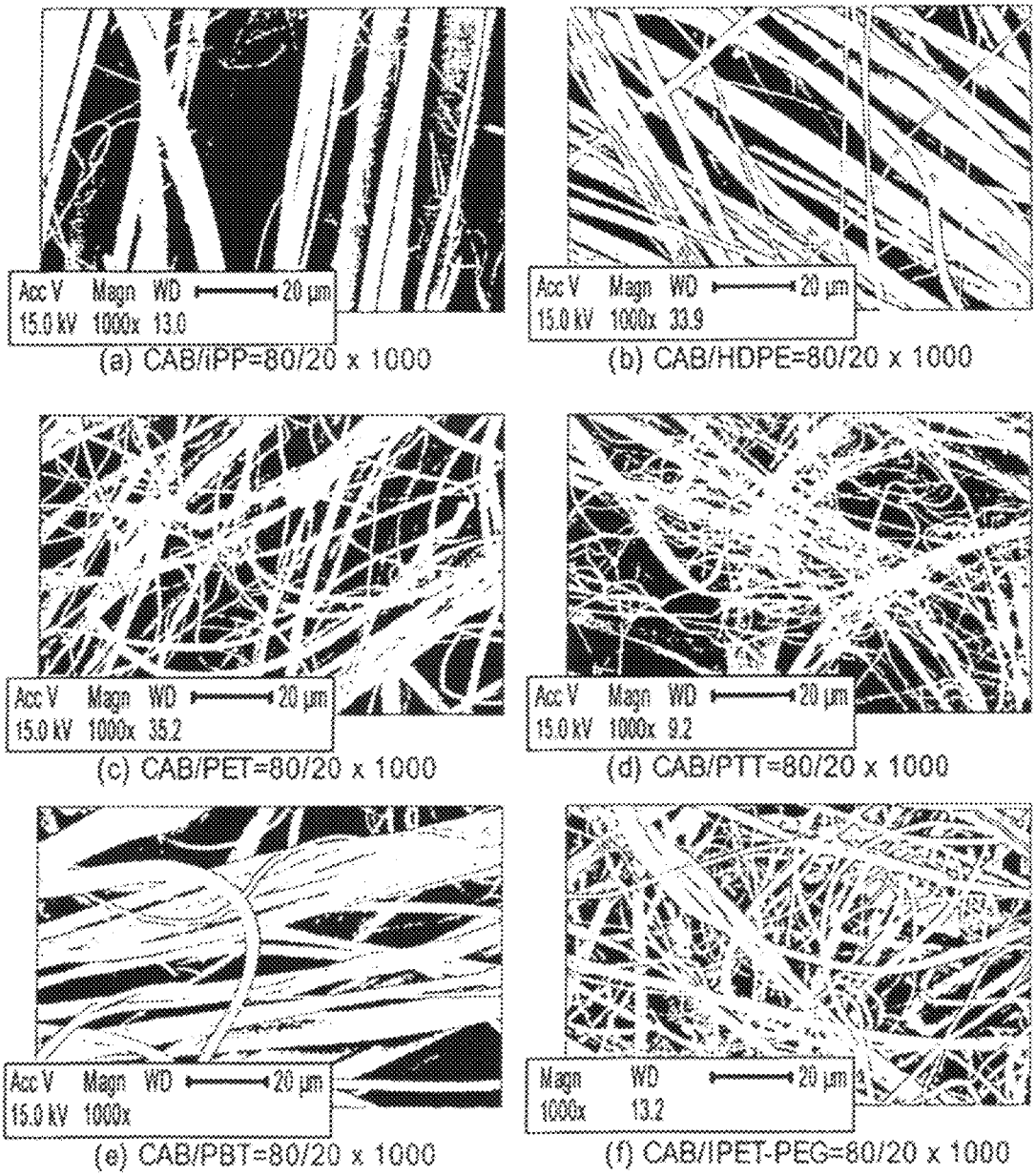
FIG. 2*a-f* illustrates a morphology of in situ microfibrillar and lamella hybrid cellulose acetate butyrate (CAB)/thermoplastics blends after hot drawing. All samples are immersed in acetone for 1 hr to etch away the CAB matrix at room temperature.

CAB was dry-mixed with the thermoplastics mentioned above, iPP, LDPE, HDPE, PET, PTT, PBT, IPET-PEG or HCDP at a weight ratio of 80/20. The ram extrusion of the binary mixture was performed on a Capillary Rheometer LCR 8052 (Kayness, Inc. PA 19543). Two general round dies with L/D ratio of 30 were used to investigate the effect of L/D ratio on the formation of the specific morphology, and the configurations of the dies were shown in FIG. 1B. The temperatures for CAB/iPP, CAB/LDPE, CAB/HDPE and CAB/PTT binary mixtures were 240° C. But for CAB/PET, PBT, CAB/IPET-PEG and CAB/HCDP mixtures, the temperatures were 260° C. to avoid serious thermal degradation of CAB at 280° C., the general processing temperature for PET. The ram rate was maintained at 10 mm/min. The extrudates were hot-drawn at the die exit by a take-up device keeping a drawn ratio of 25 (the area of cross section of the die to that of the extrudates) and cooled to room temperature at air. For comparison, the extrudates without hot drawing were also collected.

To further study the effect of second melt processing on the morphologies, the extrudates obtained were palletized and reprocessed under the same processing temperature and ram rate described above. The drawn ratio was also remained at 25.

Example 2

Preparation of Thermoplastic Nanofibers

The polymers used in this study were dried prior to mixing and melt blending. The mixtures of CAB/iPP, CAB/PE-co-GMA, and PTT were gravimetrically fed into a Leistritz co-rotating twin-screw (18 mm) extruder (Model MIC 18/GL 30D, Nuremberg, Germany). The feed rate was 12 g $min^{-1}$ and the screw speed was 100 rpm. Barrel temperature profiles were 150, 180, 200, 220, 235, and 240° C. The blends were extruded through a two strand (2 mm in diameter) rod die. The extrudates were hot-drawn at the die exit by a take-up device keeping a drawn ratio of 25 (the area of cross section of the die to that of the extrudates) and air-cooled to room temperature.

Example 3

Determination of the Average Diameter of the Nanofibers

The extrudates were immersed in acetone at room temperature for 15 min to remove CAB from the blends. The bundles of iPP, PE-co-GMA, and PTT nanofibers obtained were observed using a Philips XL30 Scanning Electron Microscope (SEM). One hundred of fibers were employed in calculating the number average and distribution of nanofiber diameters. The number average diameter is calculated as follows:

$$\overline{D_n} = \frac{\sum N_i D_i}{\sum N_i} \quad (1)$$

where $\overline{D_n}$ is the number-average diameter. $N_i$ is the number of nanofibers with a diameter of $D_i$.

Morphological Observation and Determination of Averaged Diameters of Microfibrils To clearly demonstrate the microfibrillar and lamellar hybrid morphology, the extrudates were immersed in acetone at room temperature for 1 h to remove the CAB matrix. The bundles of TP microfibrils obtained were sputtered with conductive gold, and then observed at a Philips XL30 Scanning Electron Microscope (SEM) with an acceleration voltage of 15 kV. Fifty microfibrils were measured to obtain the fiber diameter ranges. Number averaged diameters of microfibrils were calculated as follows:

$$D_N = \frac{\sum N_i D_i}{\sum N_i}$$

where $D_N$ is the number averaged diameter, $N_i$ is the number of microfibrils with a diameter of $D_i$.

Example 4

Rheological Characterization and Determination of Viscosity Ratios of Polymers

The melt-flow behavior of polymers used in this study were performed on a Capillary Rheometer LCR 8052 (Kayness, Pa. 19543), using a capillary round die with an L/D ratio of 30 and an entrance angle of 120°. Barrel temperature was at 240° C. for CAB, iPP, LDPE, HDPE, PTT, and PBT. For PET, IPET-PEG and HCDP it was 260° C. The intrinsic viscosities of original and recycled CAB were measured using Ubbelohde rheometer with acetone as the solvent at 25° C.

Viscosity ratios of polymers ($\eta_{dispersed}/\eta_{CAB}$) were calculated at 240° C. at the apparent shear rate of 100 $s^{-1}$. Interfacial tensions between CAB and dispersed phases, iPP, PTT, and PE-co-GMA at 240° C. were estimated based on Equation (2).

$$\gamma_{12} - \gamma_1 + \gamma_2 - \frac{4\gamma_1^d\gamma_2^d}{\gamma_1^d + \gamma_2^d} - \frac{4\gamma_1^p\gamma_2^p}{\gamma_1^p + \gamma_2^p} \quad (2)$$

where $\gamma$ is the surface tension, $\gamma^d$ its dispersive component, and $\gamma^p$ its polar component. The subscripts 1 and 2 correspond to the two polymer materials. [S. H. Wu, "*Polymer Interface and Adhesion,*" Marcel Dekker, New York 1982].

The viscosity ratios of CAB/iPP, CAB/HDPE, CAB/LDPE, CAB/PET, CAB/PTT, CAB/PBT, CAB/HCDP and CAB/IPET-PEG blends prepared through L/D=30 die extrusion and hot drawing are listed in Table 1.

TABLE 1

Viscosity ratio at apparent shear rate 115 $s^{-1}$ and statistical data of diameter distributions of microfibers in CAB/Thermoplastics blends prepared by L/D = 30 die and hot drawing.

| | Weight Ratio | Viscosity Ratio $\eta_{TP}/\eta_{CAB}$ | Morphology of Minor phase | Minimum/Maximum Diameter of microfibils (μm) | Average Diameter (μm) |
|---|---|---|---|---|---|
| iPP/CAB | 20/80 | 0.42 | Fiber, lamella | 0.4-8.5 | 3.4 |
| HDPE/CAB | 20/80 | 1.32 | Fiber, lamella | 0.2-7.6 | 2.7 |
| LDPE/CAB | 20/80 | 0.33 | Lamella | — | — |
| PET/CAB | 20/80 | 0.53 | Fiber, lamella | 0.4-2.8 | 1.4 |
| PTT/CAB | 20/80 | 0.83 | Fiber, lamella | 0.1-2.5 | 0.7 |
| PBT/CAB | 20/80 | 6.38 | Fiber, lamella | 0.4-9.4 | 3.7 |
| IPET-PEG/CAB | 20/80 | 1.05 | Fiber | 0.2-5.7 | 1.2 |
| HCDP/CAB | 20/80 | 1.00 | Lamella | — | — |

Example 5

Morphology of Hot-Drawn CAB/Thermoplastic (TP) Microfibrillar Blends

Figure 3:
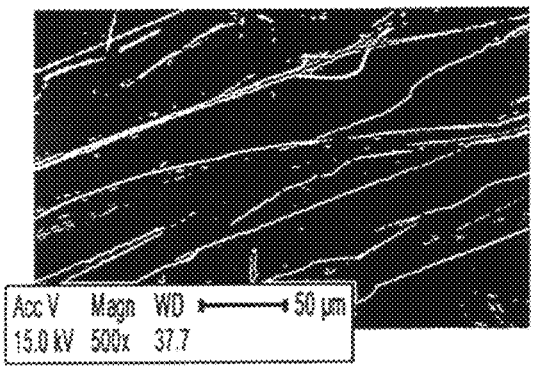
FIG. 3*a-b* illustrates a morphology of in situ lamella CAB/thermoplastics blends after hot drawing. All samples are immersed in acetone for 1 hr to etch away the CAB matrix at room temperature.
Figure 3:
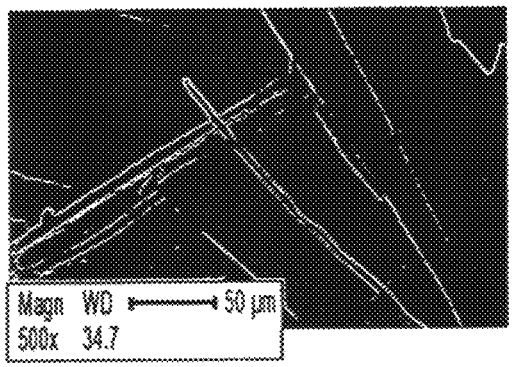
Figure 4:
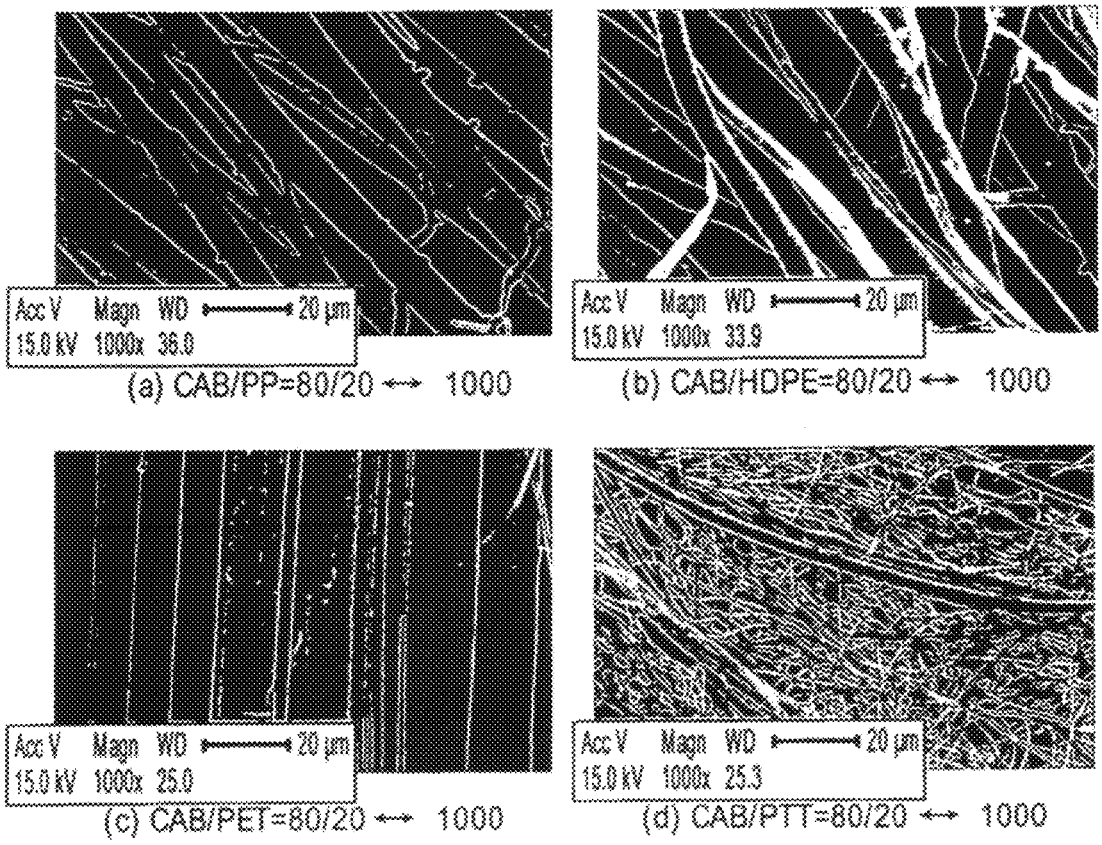
FIG. 4*a-d* illustrates the morphology of in situ microfibrillar and lamella hybrid CAB/thermoplastics=80/20 blends without hot drawing. All samples are immersed in acetone for 1 hr to etch away the CAB matrix at room temperature.

FIGS. 3 and 4 illustrate the morphology of blends from CAB and eight general thermoplastics after etching away the CAB matrix with acetone according to an embodiment of the present invention. All sample are immersed in acetone for 1 hr to etch away the CAB matrix at room temperature. All six blends, CAB/iPP, CAB/HDPE, CAB/PET, CAB/PTT, CAB/PBT and CAB/IPET-PEG exhibit the well defined in situ microfibrillar and lamellar hybrid morphology. The microfibril form is predominant for the existences of minor phases of iPP, HDPE, LDPE, PET, PTT, PBT and IPET-PEG in the blends. Few lamellae intermingled with the microfibril can be observed in FIG. 3. It can be found that the diameters of minor phases of six thermoplastics were not uniform and had wide distributions. The statistical data of the diameter distributions of microfibers for CAB/iPP, CAB/HDPE, CAB/PET, CAB/PTT, CAB/PBT and CAB/IPET-PEG blends are listed in Table 2. PBT/CAB blend had the broadest diameter distribution, ranging from the 0.4 to 9.4 μm, followed by iPP/CAB, HDPE/CAB from 0.4-8.5 μm and 0.2-7.6 μm, respectively. The distributions for CAB/PET and CAB/PTT blends were the narrowest with the range of 0.4-2.8 μm and 0.1-2.5 μm. The average diameters for the six blends are at the micron level, for PTT it even can reach sub-micron, 0.7 μm Despite the different diameter distributions and average diameters, it can be shown that the minimum diameters are pretty close, all in the range of 0.1-0.4 μm. However, the minor phases of LDPE and HCDP mainly formed the lamellar morphology, as shown in FIG. 3. LDPE lamellas were flexible due to the observation that the lamellae were continuous and could randomly bend and twist. On the contrary, HCDP lamellas were brittle and breakable, which can be found from the observation that in the view field of SEM pictures there were brittle fracture ends. Despite the different diameter distributions and average diameters, it can be shown that the minimum diameters were pretty close, all in the range of 0.2-0.4 μm.

TABLE 2

Statistical data of diameter distributions of microfibers in CAB/Thermoplastics blends at different processing conditions

| | Processing Conditions | Minimum/Maximum Diameter of fiber (μm) | | Average Diameter (μm) |
|---|---|---|---|---|
| iPP/CAB | Before drawing, L/D = 30 | 2.8-18 | Fiber | 7.6 |
| | After drawing, L/D = 30 | 0.4-8.5 | Fiber & Lamella | 3.4 |
| | Second melt extrusion and After drawing, L/D = 30 | 0.2-2.4 | Fiber & Lamella | 1.8 |
| HDPE/CAB | Before drawing, L/D = 30 | 1.0-14.5 | Fiber & Lamella | 6.5 |
| | After drawing, L/D = 30 | 0.2-7.6 | Fiber & Lamella | 2.7 |
| | Second melt extrusion and After drawing, L/D = 30 | 0.2-5.4 | Fiber & Lamella | 1.6 |
| PET/CAB | Before drawing, L/D = 30 | 0.9-6.2 | Fiber & Lamella | 2.8 |
| | After drawing, L/D = 30 | 0.4-2.8 | Fiber & Lamella | 1.4 |
| | Second melt extrusion and After drawing, L/D = 30 | 0.2-2.5 | Fiber | 1.0 |
| PTT/CAB | Before drawing, L/D = 30 | 0.2-4.0 | Fiber & Lamella | 1.3 |
| | After drawing, L/D = 30 | 0.1-2.5 | Fiber & Lamella | 0.7 |
| | Second melt extrusion and After drawing, L/D = 30 | 0.1-2.4 | Fiber & Lamella | 0.9 |

Example 6

Morphology of CAB/TPs Microfibrillar Blends without Hot Drawing

To investigate the effect of hot drawing process of the CAB/TPs blends as extruded from the round die on the formation of in situ microfibrillar and lamellar morphology, SEM photographs of in situ microfibrillar and lamella hybrid CAB/Thermoplastics blends etched with acetone without experiencing hot drawing are shown in FIG. 4. The microfibrillar and lamellar morphology still form even the as-extruded blends are not subjected to the hot drawing process. The diameters of the microfiber are approximately twice larger than that of the blends after hot drawing and the diameter distribution is about twice broader, as shown in Tables 1 and 2. Moreover, it can be found that the diameters and distributions for CAB/polyolefin blends, CAB/iPP and CAB/HDPE are lager and wider than those for CAB/polyester blends, CAB/PET and CAB/PTT.

Example 7

Morphology of CAB/TPs Microfibrillar Blends after Second Melt Extrusion

Figure 5:
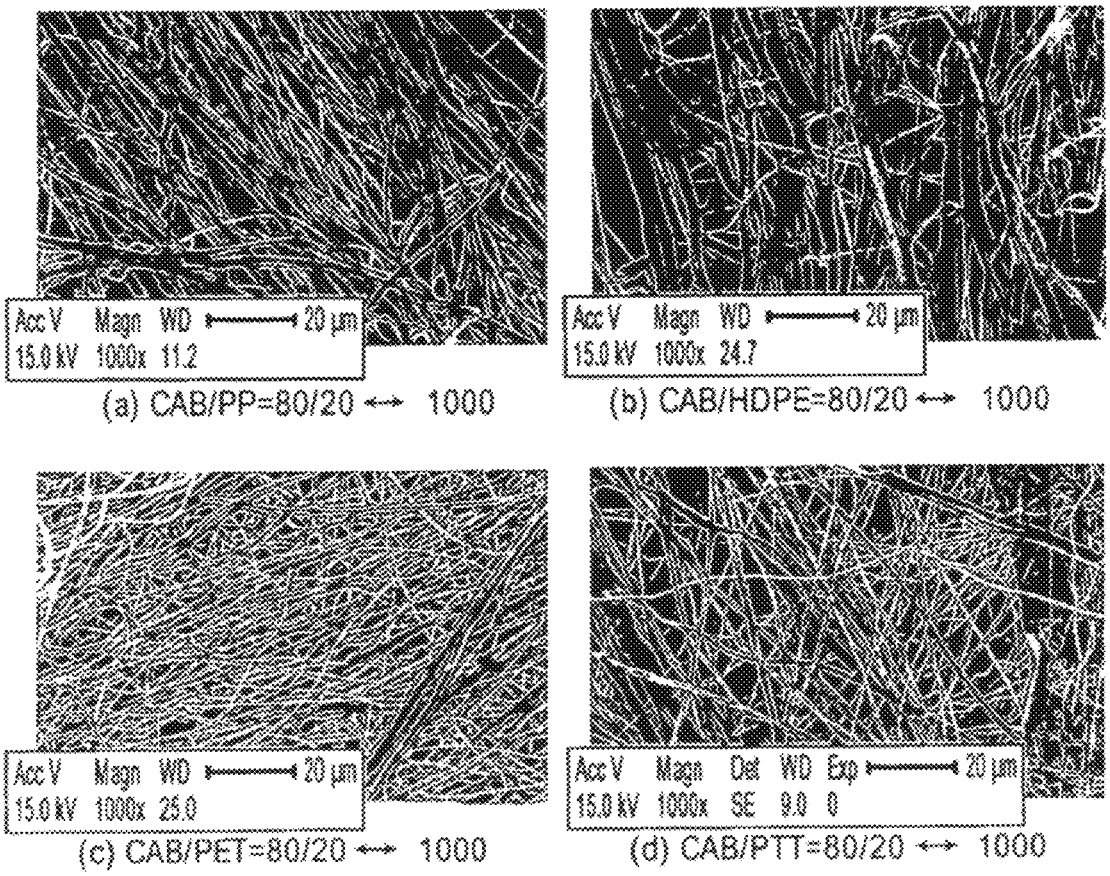
FIG. 5*a-d* illustrates the morphology of in situ microfibrillar and lamella hybrid CAB/thermoplastics blends after second melt extrusion and hot drawing. All samples are immersed in acetone for 1 hr to etch away the CAB matrix at room temperature.

The as extruded CAB/Thermoplastics blends were pelletized and fed into the barrel, and then extruded them into the continuous rods at the same temperature as the first melting process 240° C., followed by the hot drawing at the die exit. The CAB matrix was etched away and the morphologies of the samples obtained were presented in FIG. 5. The amazing phenomena were that the minor phases of the iPP, HDPE, PET and PTT in microfibrillar form did not return to stable spherical morphology, but still form the continuous microfibrils with smaller diameter than the microfibrils obtained either before drawing or after drawing. Furthermore, the distributions of microfibril diameters were narrower, as listed in Table 2.

Example 8

Comparison of Morphologies

The in situ microfibrillar and lamellar morphology of a minor phase, which is observed in CAB/iPP, CAB/HDPE, CAB/PET, CAB/PTT, CAB/PBT and CAB/IPET-PEG melt blends with a weight ratio of 80 to 20 prepared by general round capillary die extrusion and either after drawing or before a drawing process. In certain instances, only lamellar morphology is seen in CAB/HCDP and CAB/LDPE blends as a result of the breakup of minor phases, elongation of single particles and coalescence of highly elongated ellipsoidal particles under the elongation flow field at the capillary die entrance and inside the die. The hot drawn CAB/iPP, CAB/HDPE, CAB/PET, CAB/PTT, CAB/PBT and CAB/IPET-PEG blends have broad diameter distributions of microfibrils ranging from one micron to several microns. The minimum diameters from all processes are very close, all in the range of 0.1-0.4 μm Compared to the hot drawn CAB/Thermoplastics blends, the average diameter is larger and the diameter distributions are broader for the CAB/Thermoplastics blends without hot drawing. In addition, CAB/PET and CAB/PTT blends without drawing have a smaller average diameter and narrower diameter distributions than those of CAB/iPP and CAB/HDPE blends due to the fact that the better interfacial adhesion and more effective applied stress transference for CAB/PET and CAB/PTT blends. The classical relationship between the viscosity ratio and the morphology features can be found and applied to explain why the CAB/PBT blends have the broadest diameter distribution. During the second melt extrusion process of pelletized CAB/Thermoplastics blends at a temperature, which is the same as the first extrusion temperature, the microfibrils already formed of minor phases do not relax and return to the stable spherical morphology, they have experienced elongation again passing through the die, which led to a smaller average diameters and narrower diameter distributions of microfibrils with comparison of the drawn and not hot drawn blends.

Example 9

Coalescence of Particles of Minor Phases

Figure 6:
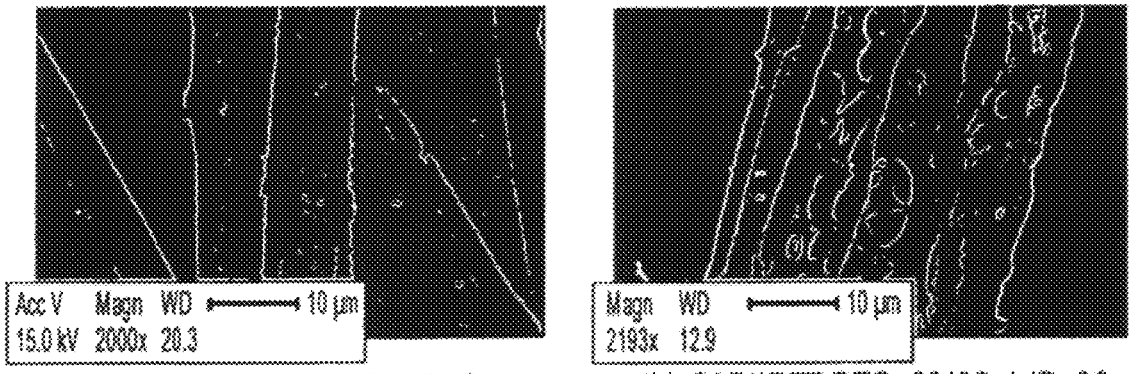
FIG. 6*a-b* illustrates the coalescence of particles of minor phases.

Single particle deformation and coalescence process of particles are the crucial steps in the formation of microfibrillar and lamellar morphologies under melt processing condition. Tsouris and Tavlarides [C. Tsouris and L. L. Tavlarides, *AIChE Journal,* 40:395-406 (1994)] reported that coalescence efficiency increased with lower continuous and dispersed phase viscosities, larger drop size and higher energy input based on a model. But they did not give direct evidence to prove the critical role of coalescence in the formation of microfibril and lamella. FIG. 6 presents some evidences obtained from CAB/PET and CAB/IPET-PEG blends for the coalescence of particles of minor phases. It can be found the whole microfiber is comprised of single particles stacked together. The adjacent particles of minor phases aggregated each other and construct the fiber. FIG. 6(*b*) shows the formation of an imperfect morphology.

Example 10

Morphology of CAB/TPs Blends Prepared by Thermal Mixing

Figure 8:
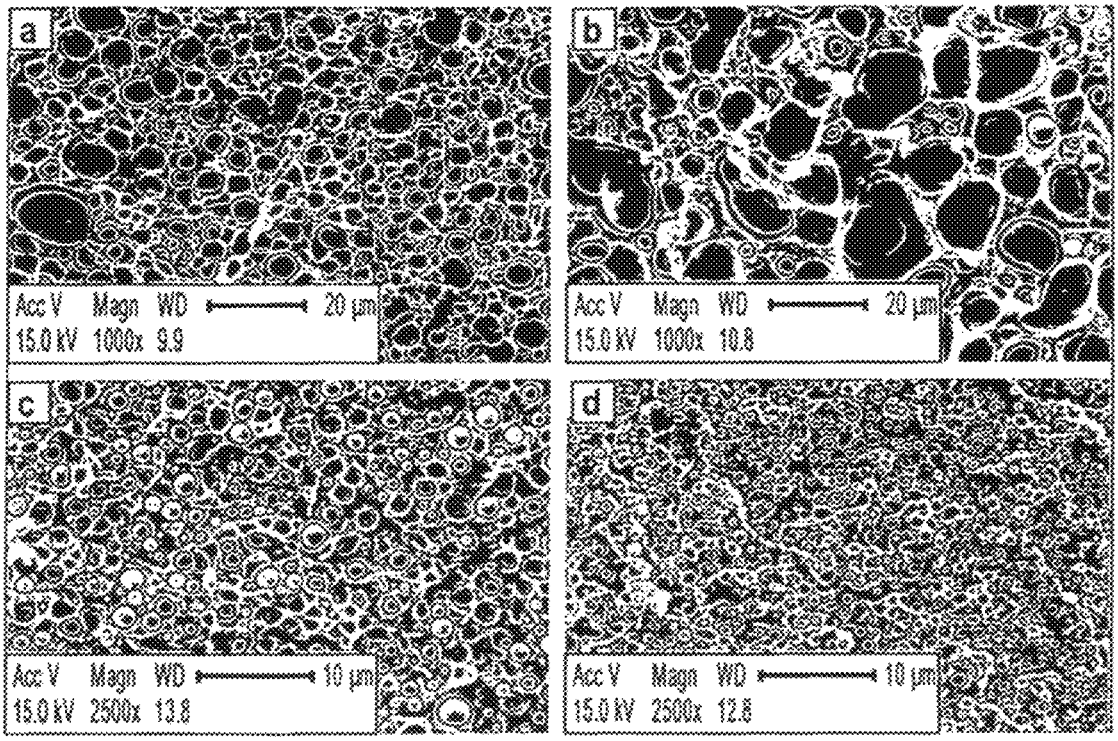
FIG. 8*a-d* illustrates SEM images of CAB/thermoplastics=80/20 blends processed in the mixer. (a) CAB/iPP, (b) CAB/HDPE, (c) CAB/PET, (d) CAB/PTT. (a, b) scale bar: 20 μm, (c, d) scale bar: 10 μm.

It is well known that a combination of shear and elongational force fields exists during melt extrusion. To investigate the roles of shear and elongational force fields on the formation of microfibrillar and lamellar morphology, CAB/iPP, CAB/HDPE, CAB/PET and CAB/PTT blends were thermally mixed in the mixer where shear force field is predominant at the same blend ratio of 80/20. The fracture sections of the CAB/TPs blends are shown in FIG. 8. It can be found the dispersed phases, iPP, HDPE, PET and PTT all existed in forms of spheres, instead of microfibrils and lamellas. Diameter distributions and number averaged diameters of the spherical particles followed the same trends with the observations of microfibrils described above. For HDPE, the diameter distribution was the broadest and the average diameter was the largest, followed by iPP, PET and PTT. Under shear force field only spherical TP phases formed in the blends and the changes in diameters of spherical particles were consistent with those of microfibrils prepared from melt extrusion (Table 2). It should be noted that the forces in a mixer is different from those in extruder and die, one is a batch process and the other is a continuous one. Polymers in the mixer are subjected to the shear force, positive displacement and chaotic effects, leading to a more complex flow condition for material distribution and dispersion. In contrast, for the processing of pre-mixed polymer in the capillary extruder, steady-state shear can be assumed. In a capillary die the direct mechanical mixing effect is absent, but the elongational force exists on the microspherical particles. Therefore, the existence of microspherical dispersed phase and elongational force field to deform the microspheres were two key factors in the formation of microfibrillar and lamellar hybrid morphology.

Example 11

Figure 9A:
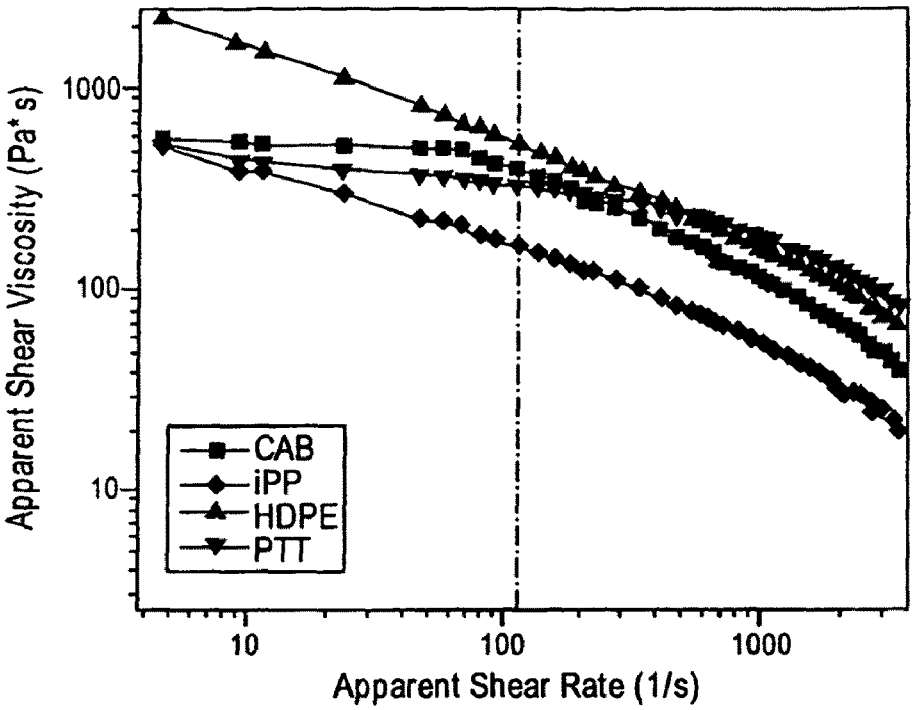
FIGS. 9A-9B illustrate the apparent shear viscosity of CAB, iPP, HDPE and PTT versus apparent shear rate at 240° C.
Figure 9B:
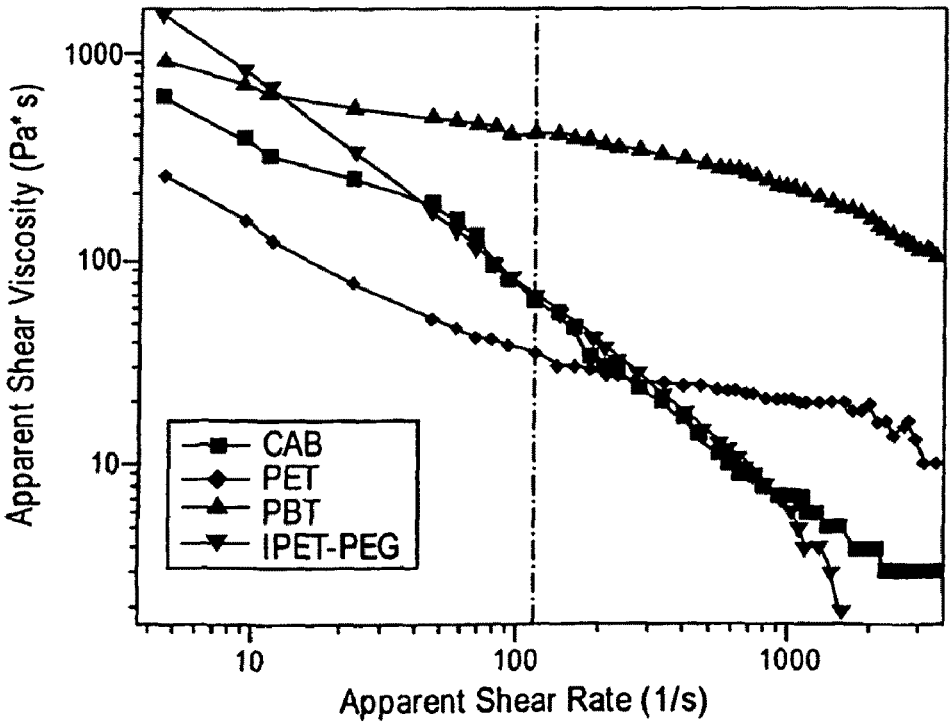

Analysis of Formation Process of In Situ Microfibrillar and Lamellar Hybrid Blends The melt flow behaviors of CAB, iPP, HDPE, PET, PTT, PBT and IPET-PEG are shown in FIGS. 9A and 9B. With increasing the apparent shear rate the apparent shear viscosity decreased continuously, implying that the CAB and thermoplastic melts were non-Newtonian fluids and all followed the shear-thinning behavior. The viscosity ratios, of iPP, HDPE, PET, PTT, PBT and IPET-PEG to CAB matrix, an L/D=30 die and an apparent shear rate of 115 $s^{-1}$ are listed in Table 2. Obviously the viscosity ratios ($\eta_d/\eta_m$) varied dramatically from $\eta_d/\eta_m$>1 (HDPE/CAB) to <1 (iPP/CAB). Therefore, it is difficult to conclude the direct relationship between viscosity ratio and the morphology.

Based on the morphology changes of the dispersed phases from spheres in the mixer where shear force field is predominant to microfibrils and lamellas through melt ram extrusion, the elongation flow field would be of great importance to the morphology development. It is well known that when the melt flow through the entrance of a capillary die, the melt would undergo the elongation flow field because of the convergence effect at the entrance. Without being bound by the theory, the formation of the microfibrillar and lamellar hybrid morphology in both as-extruded and after drawn CAB/thermoplastics blends at the die exit suggested that the die entrance and the capillary die were the major places to form the hybrid morphology. Single spherical particle deformation and coalescence process of elongated particles at the entrance and inside of the die are the crucial steps in the formation of microfibrillar and lamellar hybrid morphology under melt extrusion condition.

Example 12

Effect of Blend Ratio on the Morphology of iPP Nanofibers

Figure 10:
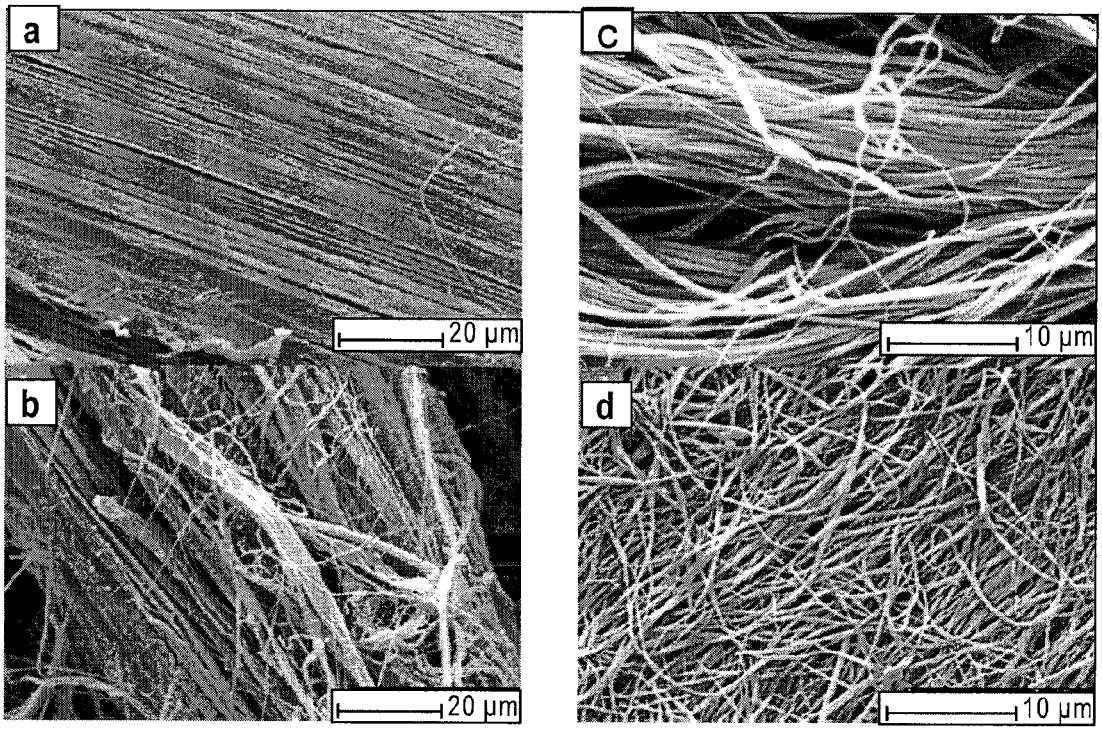
FIG. 10*a-d* shows SEM images of iPP nanofibers prepared from CAB/iPP blends in different CAB/iPP ratios after CAB removal. (a) CAB/iPP=60/40; (b) CAB/iPP—70/30; (c) CAB/iPP—80/20; (d) CAB/iPP—90/10. Scale bar: (a-b) 20, (d-c) 10 μm.

CAB forms immiscible blends with certain thermoplastic polymers at different ratios ranging from 97.5/2.5 to 10/90. However, only when the amount of CAB was above 70% in the blends did the other thermoplastic polymer start to form nanofibers after extrusion. This phenomenon is a reflection of dispersion of the thermoplastic polymer in the matrix CAB system. When CAB is in dominating amounts in the blends, the other polymer could be well dispersed in CAB. FIG. 10 presents SEM images of iPP nanofibers produced from different CAB/iPP ratios. When the CAB/iPP ratio was changed to 80/20, the nanofibers became more uniform and smaller in size. Table 3 summarizes the effects of different CAB/iPP ratios on the produced fibers. Diameter ranges were obtained by measuring the diameters of 100 nanofibers. Average diameters were number average diameters of 100 nanofibers. With increasing amounts of CAB in blends, the diameter distributions of iPP nanofibers became narrower and number average diameters decreased from 287 to 215 mu. This is due to the fact that the larger amount of CAB reduces the possibility of coalescence of elongated iPP ellipsoids. Thus, less coalescence resulted in iPP fibers with narrower diameter distributions and smaller diameters.

TABLE 3

Morphology, diameter ranges, and average diameters of iPP phases.

| Sample | Morphology | Diameter range nm | Average diameter nm |
|---|---|---|---|
| CAB/Ipp = 60/40 | Porous | — | — |
| CAB/iPP = 70/30 | Fibrillar and porous | — | — |
| CAB/iPP = 80/20 | Nanofibers | 100-550 | 287 |
| CAB/iPP = 90/10 | Nanofibers | 100-450 | 264 |

TABLE 3-continued

Morphology, diameter ranges, and average diameters of iPP phases.

| Sample | Morphology | Diameter range nm | Average diameter nm |
|---|---|---|---|
| CAB/iPP = 95/5 | Nanofibers | 100-400 | 217 |
| CAB/iPP = 97.5/2.5 | Nanofibers | 100-350 | 215 |

Example 13

Figure 11:
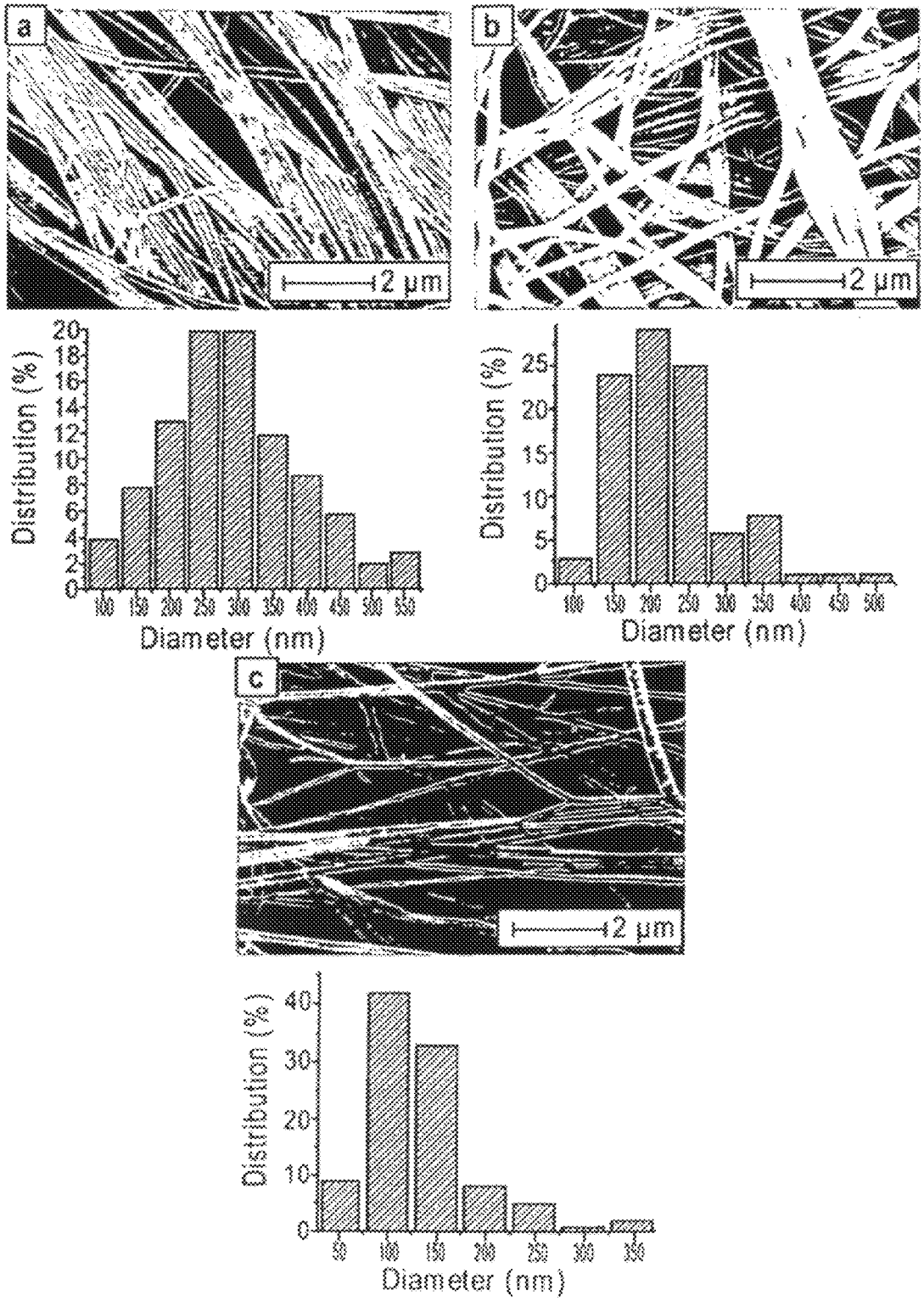
FIG. 11*a-c* illustrates SEM images and diameter distributions of (a) iPP, (b) PTT, and (c) PE-co-GMA nanofibers prepared by removing CAB matrix of CAB/iPP, CAB/PTT, and CAB/PE-co-GMA=80/20 blends. Scale bar: 2 μm.

Based on the above results, the CAB/thermoplastic polymer ratio was set at 80/20 to test other polymers. FIG. 11 shows high resolution SEM images of iPP, PTT, and PE-co-GMA nanofibers obtained from the CAB/iPP, CAB/PTT, and CAB/PE-co-GMA blends with a blend ratio of 80/20. It can be observed that the dispersed PIT and PE-co-GMA phases all formed well-defined nanofibers. Diameter distributions and number average diameters of iPP, PTT, and PE-co-GMA nanofibers are summarized in Table 4.

Among all three nanofibers, iPP formed the broadest diameter distribution, which ranged from 100 to 550 nm. On the other hand, PTT and PE-co-GMA fibers had relatively narrower distributions, which ranged from 100 to 500 and 50 to 350 nm, respectively. PE-co-GMA nanofibers not only showed the narrowest diameter distributions, but also the smallest number average diameters of 135 nm. Number average diameters of PTT nanofibers were about 223 nm and average diameters of iPP nanofibers were 287 nm.

TABLE 4

Interfacial tension and viscosity ratio between CAB and thermoplastics.

| Sample | Interfacial tension mN $m^{-1}$ | Viscosity ratio | Diameter range nm | Average diameter nm |
|---|---|---|---|---|
| CAB/iPP | 6.99 | 0.41 | 100-550 | 287 |
| CAB/PTT | 2.11 | 0.79 | 100-500 | 223 |
| CAB/PE-co-GMA | 1.20 | 0.99 | 50-350 | 135 |

Example 14

Analysis of the Formation of iPP, PTT, and PE-co-GMA Nanofibers

Figure 7:
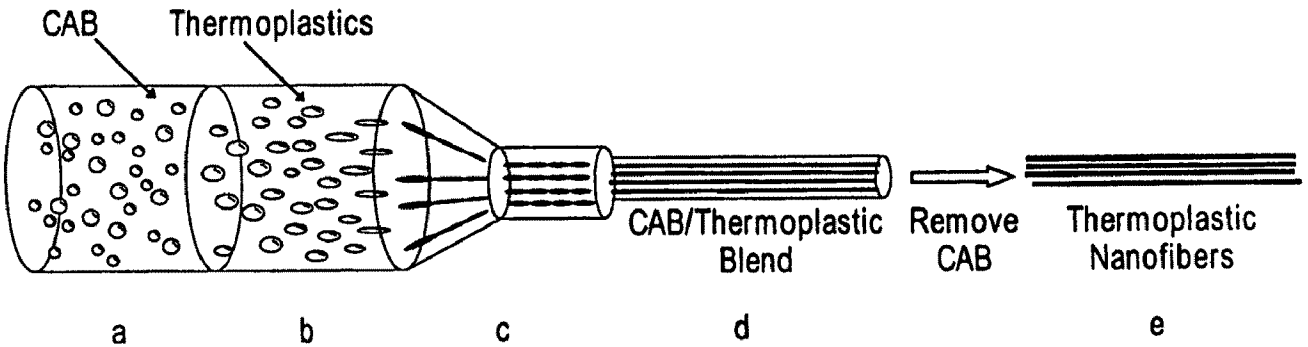
FIG. 7 shows a schematic diagram of thermoplastic nanofiber fabrication. (a) Dispersion of thermoplastics in CAB matrix into microsized micelles, (b) deformation and elongation of dispersed thermoplastic micelles into ellipsoids, (c) elongation and coalescence of thermoplastic ellipsoids, (d) CAB/thermoplastics composite fibers, (e) thermoplastic nanofibers after the removal of CAB matrix. Regions of (a-b) inside the extruder, (c) inside the die, and (d-e) in the air.

The formation of thermoplastic nanofibers in the immiscible polymer blends is dependent on two steps: micro-sized dispersion of thermoplastics in CAB and deformation of the microsized spherical micelles into nanosized fibers (FIG. 7). The dispersion of the thermoplastic in CAB is related to ratios of CAB to the thermoplastic polymer, as discussed above, and possibly, interfacial tensions between the two polymers, which should be further investigated. The deformation of the thermoplastic micelles into nanofibers involves two counteracting forces. [S. H. Wu, *Polym. Eng. Sci.,* 27, 335 (1987)] One is the normal stress difference across the drop/matrix interface dispersing and elongating the minor phase, and the other is the interfacial capillary stress acting against the breakup between melt components.

Figure 9C:
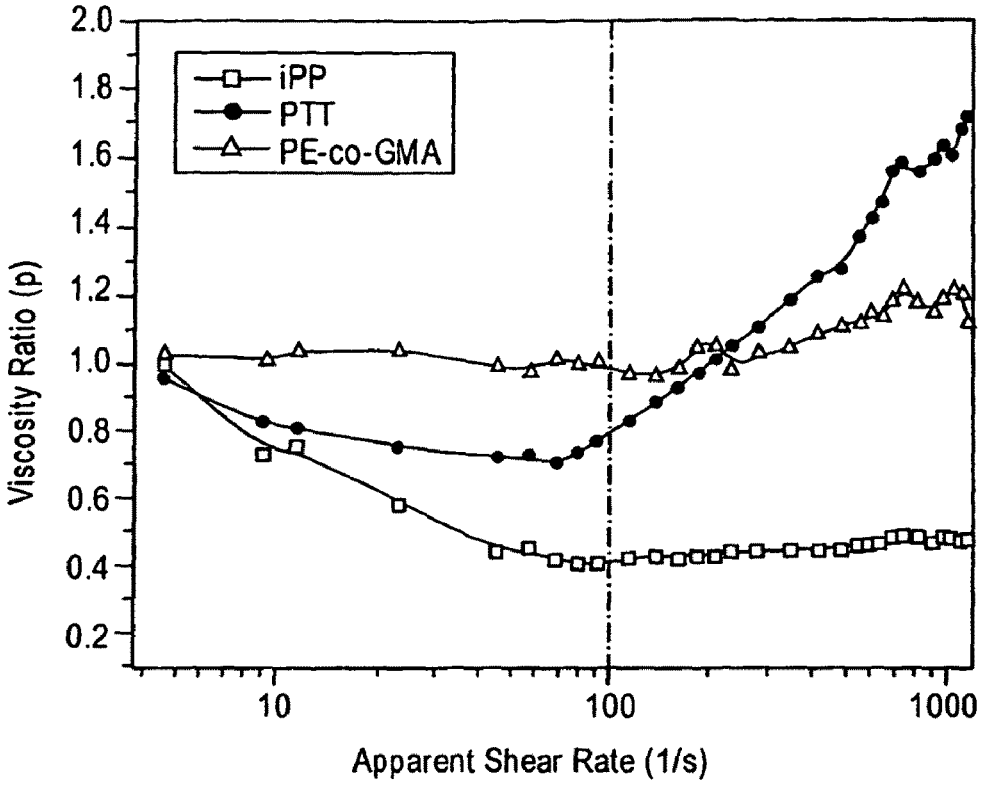
FIG. 9C illustrates viscosity ratios (p) of iPP, PTT, and PE-co-GMA to CAB as a function of apparent shear rates at 240° C.
Figure 9D:
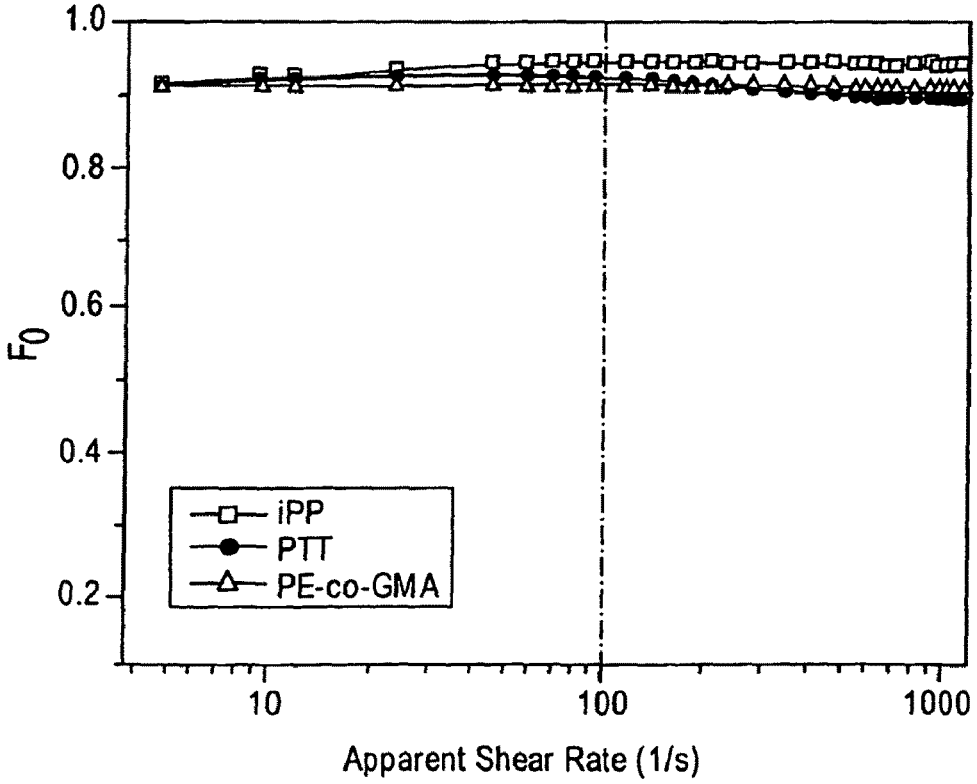
FIG. 9D illustrates $F_o$ of iPP, PTT, and PE-co-GMA to CAB as a function of apparent shear rates at 240° C.
Figure 12:
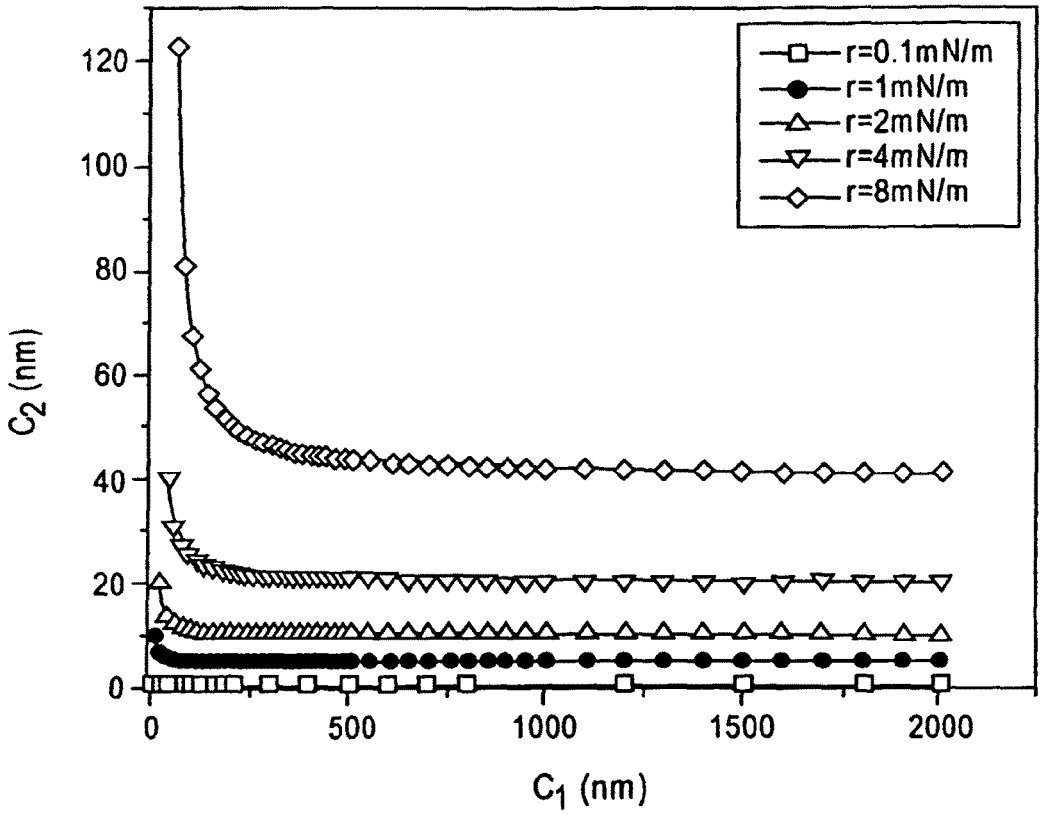
FIG. 12 illustrates the effect of interfacial tension between CAB and iPP on the radii of the curvature at 240° C. Apparent shear rate 115 $s^{-1}$, matrix viscosity 398 Pa·s, $\sin(2\phi)=1$, and F=0.922.

The normal stress difference is a function of shear rate and viscosity ratio of thermoplastic and matrix polymers [see Equation (3)]. [S. H. Wu, *Polym. Eng Sci.,* 27, 335 (1987)] The interfacial capillary stress, calculated from Laplace's equation, is proportional to the interfacial tension between components and inversely proportional to the radii of curvature [see Equation (4)] (see, id). When the curvatures of dispersed phases reach one critical minimum, the normal stress difference is balanced by the interfacial capillary stress and this minimum determines the smallest diameters of the nanofibers obtained [see Equation (5) and (6)]. The melt flow behaviors of CAB, iPP, PTT, and PE-co-GMA are shown in FIG. 9A. On increasing the apparent shear rate, the apparent shear viscosity decreased, implying that the CAB and thermoplastic melts were non-Newtonian fluids and all followed the shear-thinning behavior. For CAB/iPP, CAB/PTT, and CAB/PE-co-GMA blends under the same processing condition, the shear rate and matrix viscosity are constant. The normal stress is dependent on the viscosity ratio of dispersed phases to matrix. The experimental viscosity ratios (p) of dispersed thermoplastic polymers (iPP, PTT, and PE-co-GMA) to matrix were significantly different over the shear rate range [FIG. 9C]. However, when the viscosity ratios (p) were converted to $F_o$, there was not much difference in $F_o$ values over the shear rate range [FIG. 9D]. Thus, the viscosity ratio has little effect on the radii of curvature compared to interfacial tension, as shown in Equation (4). When the interfacial tensions between components were varied from 0.1 to 8 MN·M−1, the mathematically calculated CZ (diameter of fiber) and C1 (length) relationship showed dramatic changes, with lower interfacial ratio resulting in smaller fiber size (FIG. 12). Such a prediction is consistent with the results in Table 2. In addition, the transfer efficiency of normal stress applied by the matrix to thermoplastics should be taken into account because of the differences in interfacial adhesion of different blends.

$$\delta P_n = -4(G\eta_m F_o)\sin(2\phi) \tag{3}$$

$$\delta P_t = \gamma\left(\frac{1}{C_1} + \frac{1}{C_2}\right) \tag{4}$$

$$-\delta P_n \geq \delta P_t \tag{5}$$

$$C_2 = \frac{F_0 \gamma C_1}{4G\eta_m C_1 - F_0 \gamma} \tag{6}$$

Here, $F_o$ is a function of the viscosity ratio $F_o$=(16p+16)/(19p+16), p is the viscosity ratio $p=\eta_d/\eta_m$ and $\eta_d$ are the matrix and dispersed phase viscosity, respectively, and G is the effective shear rate. Φ is the orientation angle with respect to the direction perpendicular to the flow direction and $\Phi \cong \pi/4$ at equilibrium. $C_1$ and $C_2$ are the two principal radii of curvature, and γ is the interfacial tension of polymers.

The viscosity ratio of iPP/CAB (0.41) is lower than that of PTT/CAB (0.79), and the interfacial tension of CAB/iPP blends is about three times higher than that of CAB/PTT. Thus, the dispersed iPP spheres are subjected to lower normal stress and more likely to maintain the sphere-like shape with relatively low curvatures. In addition, the higher interfacial tension means poor interfacial adhesion, which results in the lower normal stress transfer efficiency to the thermoplastics. For CAB/PE-co-GMA blends, the dipole-dipole intermolecular interaction and hydrogen bonding between CAB and PE-co-GMA lead to the smaller interfacial tension and more effective stress transfer. Moreover, the viscosity ratio is about 0.99, which causes a higher normal stress than that of CAB/PTT or CAB/iPP blends. Thus, the PE-co-GMA can easily be dispersed, elongated, and coalesced to nanofibers with smaller diameters.

Example 15

Controllability of Nanofibers

Figure 13:
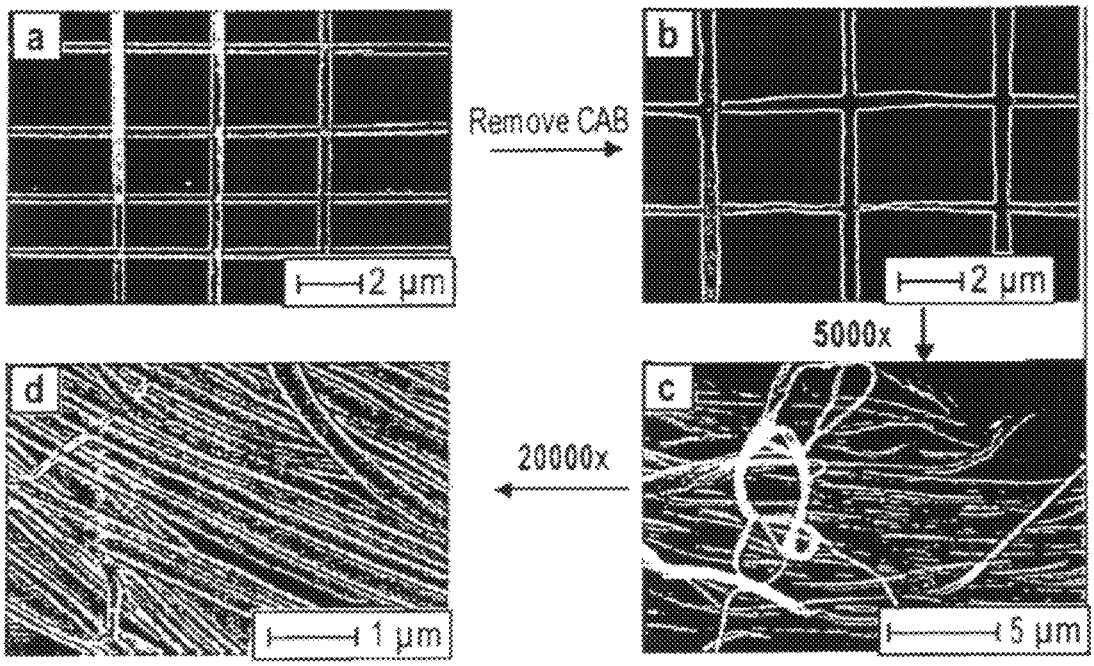
FIG. 13*a-d* illustrates a fabrication process of iPP nanofibers. (a) CAB/iPP=80/20 blend fiber (scale bar: 2 mm), (b) iPP nanofibers obtained from removing the CAB matrix (scale bar: 2 mm), (c) the bundle marked by arrow (scale bar: 5 μm), (d) the bundle magnified (scale bar: 1 μm).

This nanofiber fabrication process uses regular melt extrusion devices, thus nanofibers can be collected in continuous yarn forms, making it controllable for further processing into desired shapes and patterns. The images of the controlling iPP nanofibers at macro-scale are shown in FIG. 13. The CAB/iPP blend fibers at a blend ratio of 80-20 a) were first arranged. Then the patterned blend fibers were soaked in acetone for 15 min to remove the CAB matrix. After washing in acetone and drying in air, the pattern composed of iPP nanofibers was obtained.

Example 16

Thermal Properties of iPP Nanofibers

Figure 14:
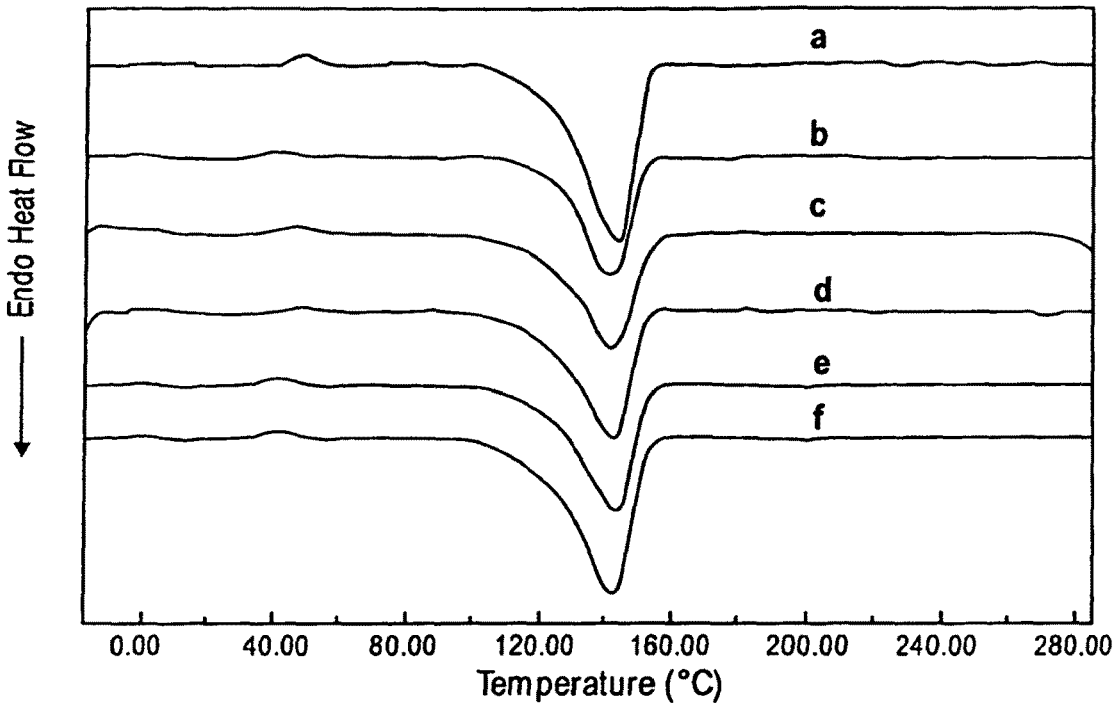
FIG. 14*a-f* illustrate DSC heating curves of (a) iPP; iPP nanofibers prepared from (b) CAB/iPP=70/30 blend; (c) CAB/iPP=80/20 blend; (d) CAB/iPP=90/10 blend; (e) CAB/iPP=95/5 blend; (f) CAB/iPP=97.5/2.5 blend.

Thermal behaviors of bulk iPP and iPP nanofibers from CAB/iPP blend ratios of 70/30, 80/20, 90/10, 95/5 and 97.5/2.5 with a hot-drawn ratio of 25 were analyzed using DSC. The heating curves of bulk iPP and iPP nanofibers are shown in FIG. 14. Bulk iPP and iPP nanofibers showed small exotherms ranging from 41 to 48° C., which can be attributed to the recrystallization of originally formed imperfect crystals during the heating process. The relatively small exotherms of bulk iPP and iPP nanofibers also indicate the amounts of those crystallites undergoing recrystallization are small. A similar observation has been reported by other investigators [20]. The results obtained from the DSC analysis are summarized in Table 5. The melting temperatures of bulk iPP and nanofibers remained relatively constant at about 141° C. In addition, there is not much difference in the width of melting endotherm peaks of iPP nanofibers, which suggested that the perfect degree of crystals did not change much. Compared with bulk iPP, the heat of fusion of iPP nanofibers was lower, but tended to increase with the increase in the amount of CAB in CAB/iPP blends. The heat of fusion depends on the crystallinity. Hence, the increase in the heat of fusion suggested that bulk iPP had higher crystallinity than iPP nanofibers, and the increase in the amount of CAB in the blends improved the crystallinity of formed iPP nanofibers.

TABLE 5

Melting temperature ($T_m$) and Heat of fusion ($\Delta H_m$)

| | Sample | $T_m$(° C.) | $\Delta H_m$(J/g) |
|---|---|---|---|
| iPP | iPP | 142.94 | 76.82 |
| Nanofibers | CAB/iPP = 70/30 blend | 140.94 | 47.80 |
| | CAB/iPP = 80/20 blend | 141.73 | 56.22 |
| | CAB/iPP = 90/10 blend | 141.92 | 57.97 |
| | CAB/iPP = 95/5 blend | 141.59 | 59.38 |
| | CAB/iPP = 97.5/2.5 blend | 142.67 | 62.89 |

Example 17

X-Ray Diffraction Studies and Crystal Structure

Figure 15:
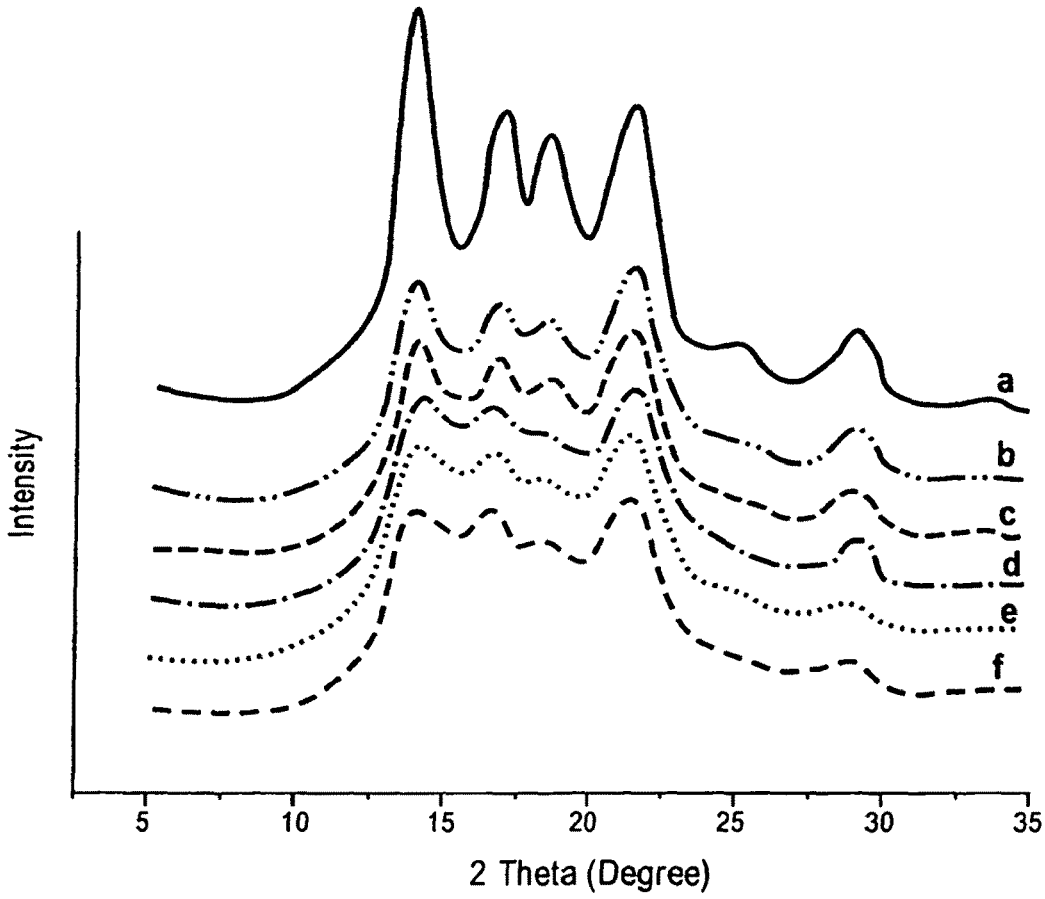
FIG. 15*a-f* illustrates wide angle X-ray diffraction (WAXD) patterns of (a) iPP; iPP nanofibers prepared from (b) CAB/iPP=70/30 blend; (c) CAB/iPP=80/20 blend; (d) CAB/iPP=90/10 blend; (e) CAB/iPP=95/5 blend; (f) CAB/iPP=97.5/2.5 blend.

To determine the crystallinity and crystalline structure of iPP nanofibers, wide angle X-ray diffraction (WAXD) was carried out and the X-ray patterns are shown in FIG. 15. Bulk iPP fibers and iPP nanofibers all exhibited the same diffraction peaks at 20 of 14.2°, 16.8°, 18.5° and 21.4°, corresponding to the 110, 040, 130 and overlapping 131, 041, 111 crystal planes, respectively. Peaks at 14.2°, 16.8° and 18.5° are characteristic of the α phase (monoclinic) of iPP crystallites and the one at 21.4° of the Y phase (triclinic) crystallites [21-22]. For bulk iPP, the intensity of the peak at 14.2° is the highest. However, in the case of iPP nanofibers, the intensity of peaks at 14.2° decreased and is almost similar to that of peaks at 21.4° assigned to the Y phase. This observation indicates that in iPP nanofibers, small amounts of a crystal are converted into Y crystal structure.

The peak widths of iPP nanofibers are larger than those of bulk iPP and increasing the amount of CAB in CAB/iPP blends resulted in broader reflection peaks. Generally, the crystallite thickness of crystals is inversely proportional to the width of diffraction peaks. The crystallite thickness of bulk iPP and iPP nanofibers were calculated based on the Scherrer Equation and listed in Table 6. Bulk iPP had the largest crystallite thickness with 51.2, 34.4, 26.5 and 28.4 Å at 14.2°, 16.8°, 18.5° and 21.4°, respectively. The increase in the amount of CAB led to the smaller crystallite thickness. It is also noted that the ratio of crystallite thickness of 111 planes to that of 110 planes became larger with an increase in the amount of CAB in the hybrid blends, which also confirmed the existence of the conversion from α crystal to Y crystal.

The crystallinity of bulk iPP and iPP nanofibers are determined by the ratio of crystalline peak area to total areas of crystalline and amorphous regions, as shown in Table 6. In agreement with the results obtained from DSC analysis, the crystallinity of bulk iPP is the highest, followed by iPP nanofibers from CAB/iPP blends with ratios of 97.5/2.5, 95/5, 90/10, 80/20 and 70/30. The changes in the crystallinity are possibly related to the formation process of iPP nanofibers in the CAB matrix. A lower iPP concentration resulted in smaller spherical dispersed iPP particles and sparser distribution of iPP particles. For CAB/iPP blends with lower amounts of iPP, the higher deformation and elongation degree are required to make the elongated ellipsoids coalesce with each other and form the continuous nanofibers. The higher elongation caused the higher orientation of iPP, and thus the higher crystallinity.

TABLE 6

Crystal sizes and degree of crystallinity obtained from wide angle X-ray diffraction patterns of iPP nanofibers

| | Sample | $L_{(110)}$ (Å) | $L_{(040)}$ (Å) | $L_{(130)}$ (Å) | $L_{(111)}$ (Å) | Degree of Crystallinity (%) |
|---|---|---|---|---|---|---|
| iPP | iPP | 51.2 | 34.4 | 26.5 | 28.4 | 52.1 |
| Nanofibers | CAB/iPP = 70/30 blend | 26.5 | 17.8 | 11.3 | 25.3 | 43.6 |
| | CAB/iPP = 80/20 blend | 24.7 | 15.6 | 10.3 | 23.8 | 44.2 |
| | CAB/iPP = 90/10 blend | 13.2 | 11.0 | / | 20.4 | 45.3 |
| | CAB/iPP = 95/5 blend | 11.7 | 10.1 | / | 18.3 | 48.0 |
| | CAB/iPP = 97.5/2.5 blend | 12.2 | 9.4 | / | 18.7 | 48.9 |

Example 18

AFM of a Single Isotactic Polypropylene Nano Fiber

Figure 16A:
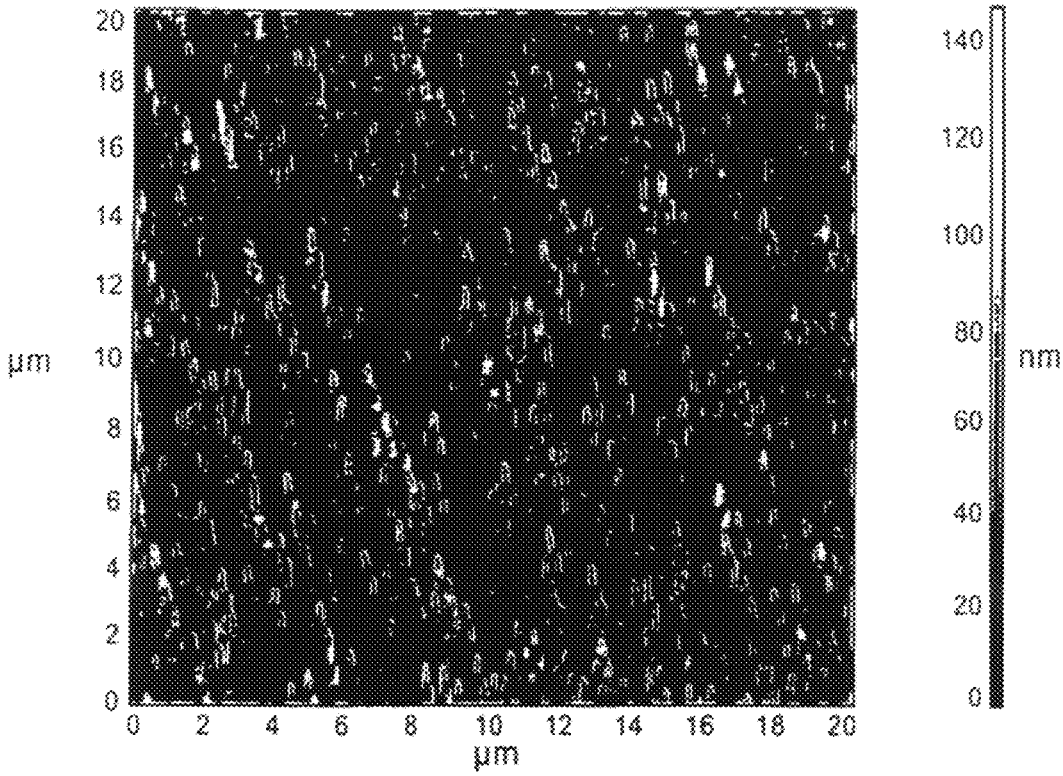
FIG. 16*a-b* illustrates AFM images of iPP nanofibers in CAB/iPP system (a), and (b) a single iPP nanofiber prepared from CAB/iPP=80/20 b lend.
Figure 16B:
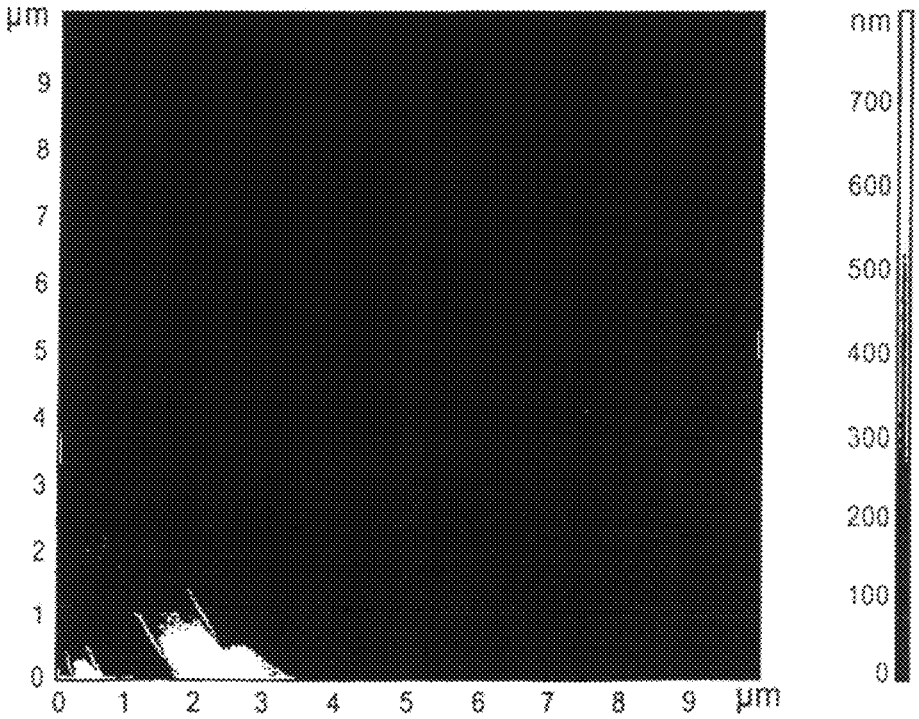

One of the advantages of the isotactic polypropylene (iPP) nanofibers prepared in forms of yarns includes the possibility to construct them into desired structures. However, we are also interested in the morphology and the manipulability of the single iPP nanofiber, which can be separated from a bundle of iPP nanofibers. Hence, AFM was used to image and manipulate the iPP nanofibers in a CAB/iPP fiber (FIG. 16). The image clearly indicates that the nanofibers are well separated in the CAB matrix. FIG. 16*b* exhibits the AFM images of iPP nanofibers obtained from removing the CAB matrix of melt extruded CAB/iPP blends with a ratio of 80 to 20. A continuous and uniform single iPP nanofiber can be separated and observed. The ability to spread and separate iPP nanofibers makes them easy to manipulate in the nano-scale.

Example 19

Preparation of a Nanofiber Filter

A conventional cellulose air filter media is used as the substrate. This substrate has a basis weight of 67 pounds per 3000 square feet, a Frazier permeability of 16 feet per minute at 0.5 inches of water pressure drop, a thickness of 0.012 inches, and a lower extremity functional scale (LEFS) efficiency of 41.6%. A fine fiber layer of isotactic polypropylene fiber is added to the surface. After exposure to 140 F air at 100% relative humidity for 1 hour the composite sample is allowed to cool and dry. LEFS efficiency is determined.

While the invention has been described by way of example and in terms of the specific embodiments, it is to be understood that examples and embodiments described herein are for illustrative purposes only and the invention is not limited to the disclosed embodiments. It is intended to cover various modifications and similar arrangements as would be apparent to those skilled in the art. Therefore, the scope of the appended claims should be accorded the broadest interpretation so as to encompass all such modifications and similar arrangements. All publications, patents, and patent applications cited herein are hereby incorporated by reference in their entirety for all purposes.

What is claimed is:

1. A thermoplastic polymer microfiber composite, said composite comprising:

a matrix, wherein said matrix is selected from the group consisting of a cellulose $C_{1-8}$alkanoate, a cellulose acetate $C_{1-8}$alkanoate, a cellulose arenoate, a cellulose $C_{1-8}$alkylated, a cellulose heteroalkylated, starch and a starch derivative; and a thermoplastic polymer microfiber embedded in said matrix, wherein said thermoplastic polymer microfiber has an average diameter less than about 8 μm, and wherein said thermoplastic polymer microfiber has a surface area of at least about 3 $m^2/g$.

2. The composite of claim 1, wherein the thermoplastic polymer microfiber has a predetermined cross-section.

3. The composite of claim 1, wherein the thermoplastic polymer and the matrix are thermodynamically immiscible.

4. The composite of claim 1, wherein said matrix is a polysaccharide.

5. The composite of claim 1, wherein said matrix is cellulose acetate or cellulose acetate $C_{1-8}$alkanoate.

6. The composite of claim 5, wherein said cellulose acetate $C_{1-8}$alkanoate is cellulose acetate butyrate having from about 17 to about 50 percent of butyrate.

7. The composite of claim 5, wherein said cellulose acetate $C_{1-8}$alkanoate is cellulose acetate pentanoate.

8. The composite of claim 1, wherein the thermoplastic polymer is selected from the group consisting of a tactic polyolefin, a polyester, a polyamide, a polyurethane, a polycarbonate, a poly(carboxylic acid) and a combination thereof.

9. The composite of claim 8, wherein the polyolefin is selected from the group consisting of high density polyethylene, low density polyethylene, polyethylene-co-glycidyl methylacrylate, polyethylene copolymers, polypropylene copolymers tactic polypropylene and tactic polystyrene.

10. The composite of claim 8, wherein said polyester is selected from the group consisting of polyethylene terephthalate (PET), polytrimethylene terephthalate (PTT), polybutylene terephthalate (PBT), poly(butylene adipate terephthalate) (PBAT), poly(ethylene terephthalate-co-isophthalate)-poly(ethylene glycol) (IPET-PEG), polycaprolactone, a highly modified cationic ion-dyeable polyester (HCDP) and a polymer having the formula:

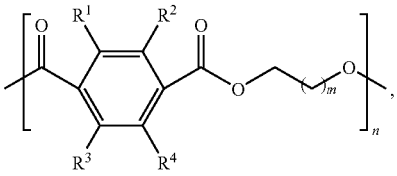

wherein $R^1$, $R^2$, $R^3$ and $R^4$ are each independently —H, a $C_{1-4}$alkyl, a $C_{1-4}$alkoxy, —OH, a halide, a $C_{1-6}$heteroalkyl, an aryl or a $C_{3-8}$heteroaryl; m is an integer from 1 to 5; and n is an integer from 1 to 2000.

11. The composite of claim 8, wherein said poly(carboxylic acid) is poly(lactic acid).

12. The composite of claim 1, wherein said thermoplastic polymer microfiber has an average diameter less than 1 μm.

13. A thermoplastic polymer nanofiber composite, said composite comprising:

a matrix, wherein said matrix is selected from the group consisting of a cellulose $C_{1-8}$alkanoate, a cellulose acetate $C_{1-8}$alkanoate, a cellulose arenoate, a cellulose $C_{1-8}$alkylated, a cellulose heteroalkylated, starch and a starch derivative; and a thermoplastic polymer nanofiber embedded in said matrix, wherein said thermoplastic polymer nanofiber has an average diameter less than 1 μm and a predetermined cross-section, and wherein said thermoplastic polymer nanofiber has a surface area of at least about 3 $m^2/g$.

14. The composite of claim 13, wherein the nanofiber has an average diameter less than about 200 nm.

15. The composite of claim 1, wherein said thermoplastic polymer microfiber has an average diameter from 0.5 μm to 5.0 μm.

* * * * *